US009353650B2

(12) United States Patent
Shindo

(10) Patent No.: US 9,353,650 B2
(45) Date of Patent: May 31, 2016

(54) STEAM TURBINE PLANT AND DRIVING METHOD THEREOF, INCLUDING SUPERHEATER, REHEATER, HIGH-PRESSURE TURBINE, INTERMEDIATE-PRESSURE TURBINE, LOW-PRESSURE TURBINE, CONDENSER, HIGH-PRESSURE TURBINE BYPASS PIPE, LOW-PRESSURE TURBINE BYPASS PIPE, AND BRANCH PIPE

(71) Applicant: Kabushiki Kaisha Toshiba, Minato-ku (JP)

(72) Inventor: Osamu Shindo, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 100 days.

(21) Appl. No.: 14/183,560

(22) Filed: Feb. 19, 2014

(65) Prior Publication Data

US 2014/0165565 A1 Jun. 19, 2014

Related U.S. Application Data

(63) Continuation of application No. PCT/JP2012/005174, filed on Aug. 16, 2012.

(30) Foreign Application Priority Data

Aug. 30, 2011 (JP) ..... 2011-187554

(51) Int. Cl.
*F01K 13/02* (2006.01)
*F01K 9/04* (2006.01)
*F01K 7/24* (2006.01)

(52) U.S. Cl.
CPC . *F01K 13/02* (2013.01); *F01K 7/24* (2013.01); *F01K 9/04* (2013.01)

(58) Field of Classification Search
CPC ..... F01K 7/24; F01K 9/04; F01K 13/02
See application file for complete search history.

(56) References Cited

U.S. PATENT DOCUMENTS 4,693,086 A * 9/1987 Hoizumi et al. ..... 60/663
4,744,723 A * 5/1988 Hashimoto et al. ..... 415/145
4,873,827 A * 10/1989 Hadano et al. ..... 60/646
5,361,585 A * 11/1994 Westphal et al. ..... 60/646

FOREIGN PATENT DOCUMENTS

JP 54-77803 A 6/1979
JP 60-79107 A 5/1985

(Continued)

OTHER PUBLICATIONS

International Search Report issued on Nov. 13, 2012 for PCT/JP2012/005174 filed on Aug. 16, 2012 with English Translation.

(Continued)

*Primary Examiner* — Audrey K Bradley
(74) *Attorney, Agent, or Firm* — Oblon, McClelland, Maier & Neustadt, L.L.P.

(57) ABSTRACT

A steam turbine plant includes: a superheater; a reheater; a high-pressure turbine; an intermediate-pressure turbine; a low-pressure turbine; a condenser; a bypass pipe that branches off a main steam pipe and includes a high-pressure turbine bypass valve; a bypass pipe that branches off a high-temperature reheat steam pipe, is connected to the condenser, and includes a low-pressure turbine bypass valve; and a branch pipe that branches off a low-temperature reheat steam pipe, is connected to the condenser, and includes a ventilator valve. At the time of turbine start up, the ventilator valve, the high-pressure turbine bypass valve, and the low-pressure turbine bypass valve are fully opened to allow steam to be circulated simultaneously into the high-pressure turbine and the intermediate-pressure turbine.

20 Claims, 7 Drawing Sheets

(56) References Cited

FOREIGN PATENT DOCUMENTS

| | | | |
|---|---|---|---|
| JP | 61-65003 | A | 4/1986 |
| JP | 63-36004 | A | 2/1988 |

OTHER PUBLICATIONS

Office Action mailed Jun. 5, 2014 in Chinese Application No. 201210313515.8 (w/English translation).

* cited by examiner

PRIOR ART

PRIOR ART

STEAM TURBINE PLANT AND DRIVING METHOD THEREOF, INCLUDING SUPERHEATER, REHEATER, HIGH-PRESSURE TURBINE, INTERMEDIATE-PRESSURE TURBINE, LOW-PRESSURE TURBINE, CONDENSER, HIGH-PRESSURE TURBINE BYPASS PIPE, LOW-PRESSURE TURBINE BYPASS PIPE, AND BRANCH PIPE

CROSS-REFERENCE TO RELATED APPLICATIONS

This application is a continuation of prior International Application No. PCT/JP2012/05174 filed on Aug. 16, 2012, which is based upon and claims the benefit of priority from Japanese Patent Application No. 2011-187554 filed on Aug. 30, 2011; the entire contents of all of which are incorporated herein by reference.

FIELD

Embodiments described herein relate generally to a steam turbine plant and a driving method thereof.

BACKGROUND

In recent years, in a steam turbine plant to be used in a thermal power plant, a turbine bypass system is often employed. This turbine bypass system is installed, and thereby it is not necessary to decrease an amount of steam generated in a boiler even when a steam turbine is in a low-load region and is stopped. Therefore, it is possible to stabilize combustion of a boiler. Particularly, the turbine bypass system is effective for improving operational functions of starting up and stopping to be performed every day.

There is increased a steam turbine plant provided with a turbine bypass system, with an increase in a middle load thermal power plant. Such a turbine bypass system is provided with two-stage bypass systems of high pressure and low pressure.

FIG. 6 and FIG. 7 each are a system diagram of a steam turbine plant provided with a conventional turbine bypass system.

In the system of the steam turbine plant shown in FIG. 6, there is employed a start up method of circulating steam into a high-pressure turbine and an intermediate-pressure turbine simultaneously. In the system of the steam turbine plant shown in FIG. 7, there is employed a start up method of circulating steam only into an intermediate-pressure turbine. The difference between both the systems is whether or not a ventilator valve is installed between an exhaust hood of a high-pressure turbine and a condenser.

As shown in FIG. 6, steam generated in a superheater 411 of a boiler 410 flows into a high-pressure turbine 500 through a main steam stop valve 420 and a steam control valve 421. The steam exhausted from the high-pressure turbine 500 passes through a check valve 422 and is led to a reheater 412 in the boiler 410 to be reheated.

The steam that has passed through the reheater 412 is introduced into an intermediate-pressure turbine 510 through a reheat steam stop valve 423 and an intercept valve 424. The steam exhausted from the intermediate-pressure turbine 510 is led to a low-pressure turbine 520. A power generator 530 is coupled to a shaft end of the low-pressure turbine 520 and the power generator 530 is driven by the high-pressure turbine 500, the intermediate-pressure turbine 510, and the low-pressure turbine 520.

The steam exhausted from the low-pressure turbine 520 is led to a condenser 540 and is condensed to be condensed water. This condensed water is led to a low-pressure feed water heater 561 and a deaerator 562 by a condensate pump 550. Then, feed water that has passed through the deaerator 562 is pressurized by a feed water pump 551 and passes through a high-pressure feed water heater 563 to flow into the superheater 411 again.

In a pipe that branches off the middle of a pipe between the superheater 411 and the main steam stop valve 420, a high-pressure bypass valve 425 and an attemperator 570 are provided. This pipe is connected to the middle of a pipe provided between the check valve 422 and the boiler 410. Further, in the attemperator 570, a cooling water regulating valve 426 is installed in order to regulate an amount of cooling water to be supplied to the attemperator 570.

In a pipe that branches off the middle of a pipe between the reheater 412 and the reheat steam stop valve 423, a low-pressure bypass valve 427 and an attemperator 571 are provided. Further, in the attemperator 571, a cooling water regulating valve 428 is installed in order to regulate an amount of cooling water to be supplied to the attemperator 571.

Unlike the system shown in FIG. 6 above, in the system shown in FIG. 7, a pipe provided with a ventilator valve 580 is provided. This pipe branches off a pipe provided between a high-pressure turbine 500 and a check valve 422 and is connected to a condenser 540. Thereby, in the system shown in FIG. 7, the steam turbine plant operates so as to vacummize the inside of the high-pressure turbine 500 at the time of turbine start up.

SUMMARY

For example, in the conventional system shown in FIG. 6, steam is circulated into both the high-pressure turbine 500 and the intermediate-pressure turbine 510 simultaneously. However, when the check valve 422 is forcibly brought into a fully closed state by pressure at an exist of the high-pressure bypass valve 425, there is sometimes a case that the valve is slightly opened by full arc admission start up by the main steam stop valve 420 and steam is circulated into the high-pressure turbine 500. In this case, due to throttle loss of the main steam stop valve 420, fore pressure of a first stage nozzle decreases in the high-pressure turbine 500. Therefore, there is sometimes a case that work is not performed effectively at rotor blades of the high-pressure turbine 500.

Further, when the main steam stop valve 420 and the intercept valve 424 are both opened simultaneously and steam whose pressure is controlled by the low-pressure bypass valve 427 is circulated into the intermediate-pressure turbine 510, a turbine rotation speed increases. Therefore, in the vicinity of an exhaust outlet having a long blade length in the high-pressure turbine 500, windage loss occurs. Thereby, temperature of an exhaust hood increases rapidly and by this temperature change, thermal stress increases on a surface of a turbine rotor of the high-pressure turbine 500. For this reason, its operating life is consumed excessively.

In order to solve this, cooling the inside of the high-pressure turbine 500 is performed by making the steam several times as large as the amount of steam to flow into the intermediate-pressure turbine 510 flow into the high-pressure turbine 500. However, this measure is not sufficient physically and in terms of a steam condition at the time of start up.

On the other hand, in the conventional system shown in FIG. 7, for example, prior to turbine start up, the ventilator valve 580 is opened and the inside of the high-pressure turbine 500 is directly coupled to the condenser 540 to be vacuumized. Then, a steam control valve 421 is brought into a fully closed state and steam is circulated only into an intermediate-pressure turbine 510 by an intercept valve 424 to increase a turbine rotation speed.

However, while an exhaust outlet of the high-pressure turbine 500 is in a vacuum, temperature is not increased by windage loss. After the intercept valve 424 is fully opened, however, the steam control valve 421 is opened rapidly and the ventilator valve 580 is closed in order to obtain a load in the high-pressure turbine 500. That is, when this steam control valve 421 is opened rapidly, on a metal part positioned downstream from the first stage in the high-pressure turbine 500, large thermal stress occurs because a temperature difference (temperature change) occurs between inflow steam temperatures.

In order to solve this, the steam control valve 421 is slightly opened to make warming steam work. However, when it is not possible to slightly open the whole steam control valves 421 simultaneously such that the steam control valve 421 is a shell mount type, for example, partial warming is made. As a result, thermal stress occurs in a nozzle box of the high-pressure turbine 500. Therefore, this measure is also not sufficient.

Further, when timing of a valve opening operation of the steam control valve 421 and timing of a valve closing operation of the ventilator valve 580 do not match, there is sometimes a case that by a difference between pressures to be generated at the front and rear of the valve, chattering of the check valve 422 occurs and the check valve 422 is broken. Further, when the ventilator valve 580 is fully closed before the steam control valve 421 is opened to a predetermined opening degree, the temperature increases by windage loss in the exhaust hood of the high-pressure turbine 500.

DETAILED DESCRIPTION

Hereinafter, embodiments of the present invention will be explained with reference to the drawings.

A steam turbine plant of an embodiment includes: a superheater; a high-pressure turbine connected to the superheater via a main steam pipe; a reheater connected to the high-pressure turbine via a low-temperature reheat steam pipe provided with a check valve; an intermediate-pressure turbine connected to the reheater via a high-temperature reheat steam pipe; a low-pressure turbine into which steam exhausted from the intermediate-pressure turbine is introduced; a condenser into which steam exhausted from the low-pressure turbine is introduced; a high-pressure turbine bypass pipe that branches off the main steam pipe, is connected to the low-temperature reheat steam pipe downstream of the check valve bypassing the high-pressure turbine, and is provided with a high-pressure turbine bypass valve; a low-pressure turbine bypass pipe that branches off the high-temperature reheat steam pipe, is connected to the condenser bypassing the intermediate-pressure turbine and the low-pressure turbine, and is provided with a low-pressure turbine bypass valve; and a branch pipe that branches off the low-temperature reheat steam pipe positioned upstream from the check valve, is connected to the condenser, and is provided with a ventilator valve.

Then, at the time of turbine start up, the ventilator valve, the high-pressure turbine bypass valve, and the low-pressure turbine bypass valve are fully opened to allow steam to be circulated into the high-pressure turbine and the intermediate-pressure turbine simultaneously.

First Embodiment

Figure 1:
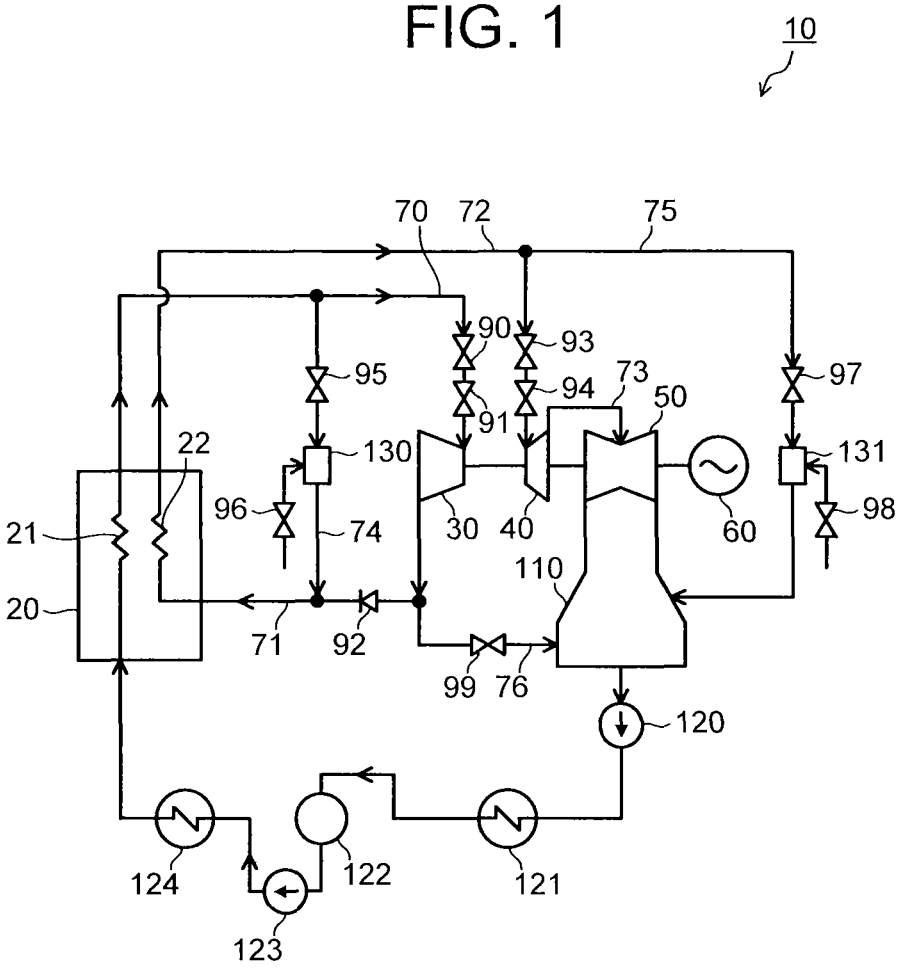
FIG. 1 is a system diagram of a steam turbine plant of a first embodiment.

FIG. 1 is a system diagram of a steam turbine plant 10 of a first embodiment. As shown in FIG. 1, main steam generated in a superheater 21 in a boiler 20 flows into a high-pressure turbine 30 through a main steam stop valve 90 and a steam control valve 91 that are provided in a main steam pipe 70. The steam exhausted from the high-pressure turbine 30 passes through a check valve 92 provided in a low-temperature reheat steam pipe 71 and is led to a reheater 22 in the boiler 20 to be reheated.

The reheated steam heated in the reheater 22 flows into an intermediate-pressure turbine 40 through a reheat steam stop valve 93 and an intercept valve 94 that are provided in a high-temperature reheat steam pipe 72. The steam exhausted from the intermediate-pressure turbine 40 passes through a crossover pipe 73 to flow into a low-pressure turbine 50. A power generator 60 is coupled to a shaft end of the low-pressure turbine 50. The high-pressure turbine 30 and the intermediate-pressure turbine 40 are coupled by a rotating shaft and the intermediate-pressure turbine 40 and the low-pressure turbine 50 are coupled by a rotating shaft, and the power generator 60 is driven by the high-pressure turbine 30, the intermediate-pressure turbine 40, and the low-pressure turbine 50 to generate power.

The steam exhausted from the low-pressure turbine 50 is led to a condenser 110 and is condensed to be condensed water. This condensed water is led to a low-pressure feed water heater 121 and a deaerator 122 by a condensate pump 120. Then, feed water that has passed through the deaerator 122 is pressurized by a feed water pump 123 and passes through a high-pressure feed water heater 124 to flow into the superheater 21 again.

Between the superheater 21 and the high-pressure turbine 30, a bypass pipe 74 branches off the main steam pipe 70. The bypass pipe 74 functions as a high-pressure turbine bypass pipe that bypasses the high-pressure turbine 30 and is coupled to the low-temperature reheat steam pipe 71. A branch portion where the bypass pipe 74 branches off the main steam pipe 70 is positioned upstream from the main steam stop valve 90 and the steam control valve 91. A coupling portion where the bypass pipe 74 is coupled to the low-temperature reheat steam pipe 71 is downstream of the check valve 92 (on the reheater 22 side).

Further, in the bypass pipe 74, a high-pressure turbine bypass valve 95 and an attemperator 130 are provided. In a pipe through which cooling water is supplied to the attemperator 130, a cooling water regulating valve 96 that regulates a supply amount of cooling water is provided.

Between the reheater 22 and the intermediate-pressure turbine 40, a bypass pipe 75 branches off the high-temperature reheat steam pipe 72. The bypass pipe 75 functions as a low-pressure turbine bypass pipe that bypasses the intermediate-pressure turbine 40 and the low-pressure turbine 50 and is coupled to the condenser 110. A branch portion where the bypass pipe 75 branches off the high-temperature reheat steam pipe 72 is positioned upstream from the reheat steam stop valve 93 and the intercept valve 94.

Further, in the bypass pipe 75, a low-pressure turbine bypass valve 97 and an attemperator 131 are provided. In a pipe through which cooling water is supplied to the attemperator 131, a cooling water regulating valve 98 that regulates a supply amount of cooling water is provided.

Between the high-pressure turbine 30 and the reheater 22, a branch pipe 76 branches off the low-temperature reheat steam pipe 71. The branch pipe 76 is coupled to the condenser 110. Incidentally, a branch portion where the branch pipe 76 branches off the low-temperature reheat steam pipe 71 is upstream of the check valve 92 (on the high-pressure turbine 30 side). Further, in the branch pipe 76, a ventilator valve 99 is provided.

Further, in the steam turbine plant 10, a control device (not shown) that controls each of the above-described valves and the like is provided. The control device is provided with an arithmetic processing device, an input/output processing device, a storage device, and the like. The control device is electrically connected to each of the above-described valves, detecting devices detecting a driving state of the steam turbine plant 10, and the like.

The detecting devices are, for example, a device detecting temperatures of component parts (for example, a nozzle box, the main steam stop valve 90, the steam control valve 91, and the like) and the like of the steam turbine, a device detecting an opening degree of each of the steam valves, a device detecting a rotation speed of a turbine rotor, a device detecting a load, a device detecting a flow rate of steam, a device detecting pressure of steam, a device detecting a system frequency, a voltage, and a phase at the time of parallel combination into an electric power system, and the like. Further, in the storage device, databases related to, for example, each setting condition and the like are stored.

The control device regulates the opening degree of each of the above-described valves and the like based on a detection signal output from each of the detecting devices, the database stored in the storage device, and the like.

Next, a driving method of the steam turbine plant 10 will be explained.

Figure 2:
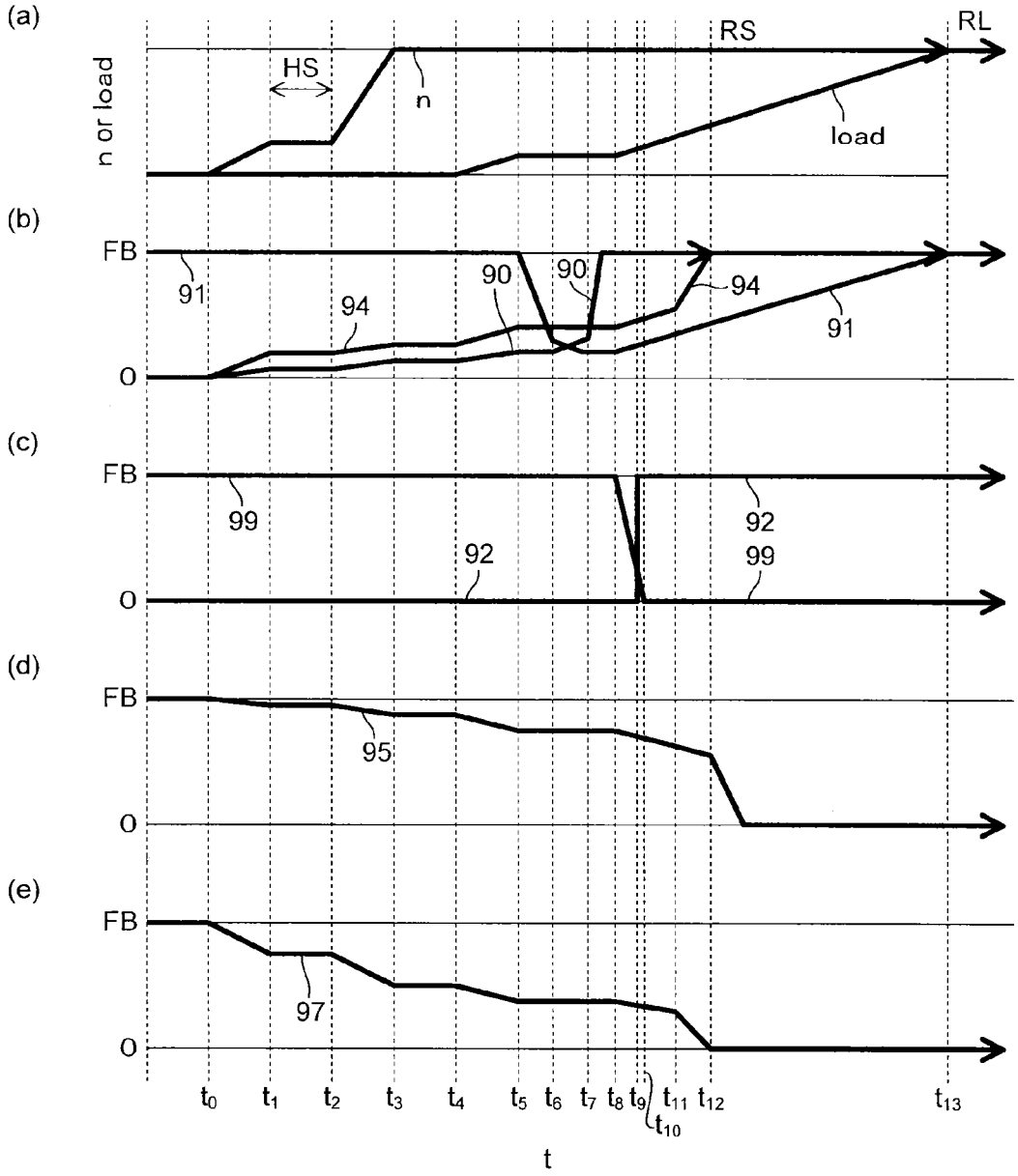
FIG. 2 is a view showing the relationship between a turbine rotation speed and a load and an opening degree of each valve at the time of steam turbine start up in the steam turbine plant of the first embodiment.

FIG. 2 is a view showing the relationship between a turbine rotation speed and a load and an opening degree of each valve at the time of steam turbine start up in the steam turbine plant 10 of the first embodiment. In FIG. 2, the horizontal axis is a time t and $t_0$ to $t_{13}$ each indicate a point of time. Then, at (a), the vertical axis indicates a turbine rotation speed n and a load (load). At (b), the vertical axis indicates the opening degrees of the main steam stop valve 90, the steam control valve 91, and the intercept valve 94. At (c), the vertical axis indicates the opening degrees of the ventilator valve 99 and the check valve 92. At (d), the vertical axis indicates the opening degree of the high-pressure turbine bypass valve 95. At (e), the vertical axis indicates the opening degree of the low-pressure turbine bypass valve 97. Incidentally, as for the vertical axis from (b) to (e), "FB" indicates that the valve is fully opened and "0" indicates that the valve is fully closed.

Incidentally, in the steam turbine plant 10 of the first embodiment, steam is circulated into the high-pressure turbine 30 and the intermediate-pressure turbine 40 simultaneously at the time of steam turbine start up. In an acceleration process of the steam turbine, the turbine rotation speed n is increased to a previously set target speed. Further, hereinafter, each of the valves is controlled by the above-described control device.

Prior to $t_0$, the reheat steam stop valve 93 is brought into a fully opened state by a reset operation of the steam turbine, which is not shown. Further, the high-pressure turbine bypass valve 95 and the low-pressure turbine bypass valve 97 are brought into a fully opened state, and turbine bypass driving is started.

At $t_0$, a sub valve (child valve) built in the main steam stop valve 90 is gradually opened from a fully closed state (see (b) in FIG. 2). At this time, the high-pressure turbine bypass valve 95 is gradually closed from a fully opened state (see (d) in FIG. 2). Then, the main steam flows into the high-pressure turbine 30 and the high-pressure turbine 30 starts (see FIG. 1).

Further, at $t_0$, the intercept valve 94 is gradually opened from a fully closed state (see (b) in FIG. 2). At this time, the low-pressure turbine bypass valve 97 is gradually closed from a fully opened state (see (e) in FIG. 2). Then, the reheated steam flows into the intermediate-pressure turbine 40 (see FIG. 1) and the steam flows from the sub valve of the main steam stop valve 90 and the intercept valve 94, to thereby increase the turbine rotation speed n (see (a) in FIG. 2).

Further, at $t_0$, the steam control valve 91 is in a fully opened state in order to correspond to full arc admission by the sub valve of the main steam stop valve 90 (see (b) in FIG. 2). Incidentally, the check valve 92 is in a fully closed state and the ventilator valve 99 is in a fully opened state (see (c) in FIG. 2). Then, from $t_0$ to $t_1$, the main steam stop valve 90 and the intercept valve 94 are gradually opened (see (b) in FIG. 2). Thereby, the turbine rotation speed n is increased to the set target rotation speed (see (a) in FIG. 2). Here, the control device, based on information of the turbine rotation speed n, performs control from $t_0$ to $t_1$ until the turbine rotation speed n reaches the set target rotation speed.

Incidentally, as for the intercept valve 94, there is one having a structure in which steam flows downstream through a hole formed in its main valve even when its main valve is in a fully closed state. Therefore, the intercept valve 94 may also be structured to have a sub valve, to thereby be structured to be capable of checking flow of steam completely. This thereby makes accurate regulation of a steam flow rate possible and controllability improves even though the reheat steam stop valve 93 is in a fully opened state.

Further, a structure in which a sub valve is provided in the reheat steam stop valve 93 may also be applied. In this case, a sub valve does not have to be provided in the intercept valve 94. Then, the intercept valve 94 may also be brought into a fully opened state to perform the regulation of a steam flow rate by the reheat steam stop valve 93. In addition to this, the regulation of a steam flow rate may also be performed by both the intercept valve 94 and the reheat steam stop valve 93. This thereby makes accurate regulation of the steam flow rate possible and controllability improves.

Incidentally, the structure in which the sub valve is provided in the above-described intercept valve 94 and reheat steam stop valve 93 is applicable also to embodiments to be described below.

Next, from $t_1$ to $t_2$, in a state of the turbine rotation speed n being kept to the set target rotation speed, heat soak driving HS is set and warming up of a steam turbine main body is performed (see (a) in FIG. 2). In this occasion, the control device, when detecting that the turbine rotation speed n has reached the set target rotation speed, keeps the opening degrees of the sub valve of the main steam stop valve 90 and the intercept valve 94 constant (see (b) in FIG. 2), to thereby keep the turbine rotation speed n constant. Further, the opening degrees of the steam control valve 91, the high-pressure turbine bypass valve 95, and the low-pressure turbine bypass valve 97 are also kept constant (see (b), (d), and (e) in FIG. 2). Here, the control device, when judging that the turbine rotation speed n has reached the set target rotation speed, based on information of the turbine rotation speed n, performs control from $t_1$ to $t_2$.

Incidentally, the control device, when judging that the temperatures of the component parts of the steam turbine have reached predetermined temperatures based on information of the temperatures of the component parts (for example, the nozzle box, the main steam stop valve 90, the steam control valve 91, and the like) and the like of the steam turbine, for example, determines that the heat soak driving HS has been completed, namely the warming up driving has been completed.

After completion of the heat soak driving HS, from $t_2$ to $t_3$, the main steam stop valve 90 and the intercept valve 94 are gradually opened (see (b) in FIG. 2), to thereby increase the turbine rotation speed n to a previously set rated rotation speed RS (see (a) in FIG. 2). In order to increase the amount of steam to flow into each of the steam turbines, the high-pressure turbine bypass valve 95 and the low-pressure turbine bypass valve 97 are gradually closed (see (d) and (e) in FIG. 2) to regulate pressures on the upstream side of these bypass valves. Here, the control device performs control from $t_2$ to $t_3$ until the turbine rotation speed n is increased to the rated rotation speed RS, based on information of the turbine rotation speed n, for example, (see (a) in FIG. 2).

After the turbine rotation speed n is increased to the rated rotation speed RS, from $t_3$ to $t_4$, the opening degree of the intercept valve 94 is kept constant and the opening degree of the sub valve of the main steam stop valve 90 is regulated slightly, and equal speed driving is performed (see (b) in FIG. 2) and an operation in which the power generator 60 is parallel combined into an electric system (whose illustration is omitted) is performed. Here, the control device, when judging that the turbine rotation speed n has been increased to the rated rotation speed RS, based on information of the turbine rotation speed n, for example, performs control from $t_3$ to $t_4$. Further, in the operation of the parallel combination into the electric system, the control device, with reference to a system frequency, for example, regulates the main steam stop valve 90, to thereby perform slight regulation of the turbine rotation speed n.

In this occasion, the opening degrees of the steam control valve 91, the high-pressure turbine bypass valve 95, and the low-pressure turbine bypass valve 97 are kept constant (see (d) and (e) in FIG. 2).

After the parallel combination into the electric system, from $t_4$ to $t_5$, the opening degrees of the sub valve of the main steam stop valve 90 and the intercept valve 94 are gradually opened (see (b) in FIG. 2), and load driving is performed until the load becomes an initial load (see (a) in FIG. 2). In order to increase the steam to flow into each of the steam turbines, the high-pressure turbine bypass valve 95 and the low-pressure turbine bypass valve 97 are gradually closed (see (d) and (e) in FIG. 2) to regulate pressures on the upstream side of these bypass valves. Here, the control device, when judging that the parallel combination into the electric system has been completed, based on pieces of information of frequencies, voltages, phases, and the like of both the electric system and the power generator 60, for example, performs control from $t_4$ to $t_5$.

After reaching the initial load, from $t_5$ to $t_8$, the full arc admission by the sub valve of the main steam stop valve 90 is switched to partial arc admission by the steam control valve 91 while the load is kept constant (see (b) in FIG. 2). In this period, the opening degrees of the intercept valve 94, the high-pressure turbine bypass valve 95, the low-pressure turbine bypass valve 97, and the ventilator valve 99 are kept constant (see (b) to (e) in FIG. 2).

Here, operations from $t_5$ to $t_8$ will be explained in detail.

From $t_5$ to $t_8$, the fully opened steam control valve 91 is gradually closed while the opening degree of the sub valve of the main steam stop valve 90 is kept constant (see (b) in FIG. 2). At a point of time of $t_5$, the steam to flow into the high-pressure turbine 30 (see FIG. 1) is controlled by the sub valve of the main steam stop valve 90 (see (b) in FIG. 2). Then, at a point of time of $t_6$, the steam control valve 91 is opened rather than the sub valve of the main steam stop valve 90 so as to have a large flow rate (see (b) in FIG. 2).

From $t_6$ to $t_7$, the sub valve of the main steam stop valve 90 is gradually opened while the steam control valve 91 is being closed (see (b) in FIG. 2). In this period, a valve that regulates the steam to flow into the high-pressure turbine 30 (see FIG. 1) is switched to the steam control valve 91 from the sub valve of the main steam stop valve 90.

Therefore, the flow rate of the steam to flow from the sub valve of the main steam stop valve 90 at $t_6$ and the flow rate of the steam to flow from the steam control valve 91 at $t_7$ are set to be the same. Then, at and after $t_7$, the flow rate of the steam to flow into the high-pressure turbine 30 (see FIG. 1) is regulated by the steam control valve 91. From $t_7$ to $t_8$, the sub valve of the main steam stop valve 90 is fully opened, and subsequently the main steam stop valve 90 itself is fully opened (see (b) in FIG. 2). In this manner, an operation of switching from the full arc admission to the partial arc admission is completed.

In this manner, the control device, when judging that the load has reached the previously set initial load, based on information of the load, for example, performs controls from $t_5$ to $t_8$. From $t_5$ to $t_8$, the control device controls the opening degrees of the sub valve of the main steam stop valve 90, the steam control valve 91, the intercept valve 94, the high-pressure turbine bypass valve 95, the low-pressure turbine bypass valve 97, and the like based on information of the load, for example, in order to keep the load and the turbine rotation speed n constant.

From $t_8$ to $t_{11}$, in order to prevent falling of the load, there is performed cooperative control in which in conjunction with an operation of opening the steam control valve 91 (an opening operation) (see (b) in FIG. 2), an operation of closing the ventilator valve 99 (a closing operation) is performed, and the ventilator valve 99 is brought into a fully closed state finally (see (c) in FIG. 2). While the opening degree of the ventilator valve 99 and the opening degree of the steam control valve 91 are controlled in conjunction with each other, the steam control valve 91 and the intercept valve 94 are controlled, and thereby the turbine rotation speed n is controlled and the turbine load is increased (see (a) in FIG. 2). With this increase in the load, the high-pressure turbine bypass valve 95 and the low-pressure turbine bypass valve 97 are gradually closed (see (d) and (e) in FIG. 2).

Here, the ventilator valve 99 approaches a fully closed state, and thereby pressure in an exhaust hood of the high-pressure turbine 30 (see FIG. 1), namely pressure on the upstream side of the check valve 92 (on the high-pressure turbine 30 side) increases. At $t_9$, the pressure on the upstream side of the check valve 92 becomes higher than that on the downstream side of the check valve 92 from a state where the pressure on the upstream side of the check valve 92 and the pressure on the downstream side of the check valve 92 (pressure at an entrance of the reheater 22) are the same. Therefore, the check valve 92 is fully opened at once (see (c) in FIG. 2). When the check valve 92 is fully opened, the whole steam that has passed through the exhaust hood of the high-pressure turbine 30 flows into the reheater 22 because the ventilator valve 99 is in a nearly closed state. Incidentally, at $t_{10}$, the ventilator valve 99 is brought into a fully closed state (see (c) in FIG. 2).

Further, from $t_9$ to $t_{11}$, the steam control valve 91 and the intercept valve 94 are controlled (see (b) in FIG. 2), to thereby increase the turbine load (see (a) in FIG. 2). Incidentally, at $t_{10}$, with the ventilator valve 99 being brought into a fully closed state, a heat drop of expansion decreases in the high-pressure turbine 30. For this reason, effective work is slightly decreased at rotor blades of the high-pressure turbine 30 (see FIG. 1). However, outputs of the intermediate-pressure turbine 40 and the low-pressure turbine 50 each having a large load shearing ratio are dominant, so that a load characteristic is not affected.

Here, the control device, when detecting that the main steam stop valve 90 has been brought into a fully opened state and judging that the full arc admission by the main steam stop valve 90 has been completed, for example, performs controls at and after $t_8$.

From $t_{11}$ to $t_{12}$, with the increase in the load (see (a) in FIG. 2), the steam control valve 91 and the intercept valve 94 are gradually opened (see (b) in FIG. 2). At $t_{11}$, however, the opening degree of the intercept valve 94 is already in a high state and a change in flow rate relative to the opening degree is small. Therefore, an inclination of a valve opening characteristic of the intercept valve 94 is increased and the intercept valve 94 is fully opened at $t_{12}$.

Further, from $t_{11}$ to $t_{12}$, pressure on the upstream side of the intercept valve 94 increases to a set value of pressure control of the low-pressure turbine bypass valve 97. For this reason, with an operation of opening the intercept valve 94 (see (b) in FIG. 2), the low-pressure turbine bypass valve 97 is brought into a fully closed state at $t_{12}$ (see (e) in FIG. 2) and the pressure control is completed. Even though, simultaneously with this control, the intercept valve 94 is brought into a fully opened state, the pressure on the upstream side of the intercept valve 94 hardly changes. For this reason, the load characteristic is not affected.

Here, the control device performs control from $t_{11}$ to $t_{12}$ based on a request to increase the load.

From $t_{12}$ to $t_{13}$, with the increase in the load, the steam control valve 91 is only used for all the controls of the load to be performed at and after $t_{12}$. Then, at $t_{13}$, the steam control valve 91 is brought into a fully opened state and the turbine load reaches a rated load RL.

Incidentally, in the middle from $t_{12}$ to $t_{13}$, capacity of the high-pressure turbine bypass valve 95 is restricted, so that with an operation of opening the steam control valve 91, the high-pressure turbine bypass valve 95 is brought into a fully closed state and the pressure control is completed.

Here, the control device, when detecting that the low-pressure turbine bypass valve 97 has been brought into a fully closed state and the intercept valve 94 has been brought into a fully opened state, performs control from $t_{12}$ to $t_{13}$.

Next, there will be explained a driving operation to be performed when the steam control valve 91 is brought into a fully closed state due to some reason or other at the time of turbine start up and/or during load driving.

In this case, supplying steam to the high-pressure turbine 30 (see FIG. 1) is stopped and the check valve 92 is brought into a fully closed state. When this state continues, the temperature of the exhaust hood of the high-pressure turbine 30 is increased due to windage loss, and thus a dangerous state is caused.

Thus, when at the time of turbine start up and/or during load driving, the steam control valve 91 is brought into a fully closed state due to some reason or other and further the check valve 92 is brought into a fully closed state, the control device opens the ventilator valve 99. Thereby, the exhaust hood of the high-pressure turbine 30 is communicated with the condenser 110 to be brought into a vacuum state. For this reason, it is possible to prevent the temperature of the exhaust hood of the high-pressure turbine 30 from being increased by windage loss.

Incidentally, one example where the full arc admission by the sub valve is performed in the main steam stop valve 90 has been described, but the present invention is not limited to this. For example, it is also possible that in a large-sized reheat steam turbine having the plural steam control valves 91 each provided with a servomotor to be controlled by the control device, at the time of start up, the main steam stop valve 90 is brought into a fully opened state and all the valves of the steam control valves 91 are slightly opened simultaneously to perform the full arc admission. Then, the full arc admission is then switched to the partial arc admission. The operation of switching from the full arc admission to the partial arc admission in the steam control valves 91 is performed from $t_5$ to $t_8$ in FIG. 2. The operation and the effect in this period are the same as those when the full arc admission is switched to the partial arc admission in the main steam stop valve 90.

According to the steam turbine plant 10 of the first embodiment, it is possible to supply steam to both the high-pressure turbine 30 and the intermediate-pressure turbine 40 simultaneously at the time of start up of the steam turbine. That is, it is possible to warm up the high-pressure turbine 30 and the intermediate-pressure turbine 40 simultaneously. For this reason, it is possible to shorten a start-up time.

Further, in this embodiment, in the branch pipe 76 provided between the exhaust hood of the high-pressure turbine 30 and the condenser 110, the ventilator valve 99 is provided. For this reason, opening the ventilator valve 99 makes it possible to vacuumize the exhaust hood of the high-pressure turbine 30. This thereby makes it possible to prevent the temperature of the exhaust hood of the high-pressure turbine 30 from being increased by windage loss even when the steam control valve 91 is brought into a fully closed state and further the check valve 92 is brought into a fully closed state at the time of turbine start up and/or during load driving, for example.

Second Embodiment

Figure 3:
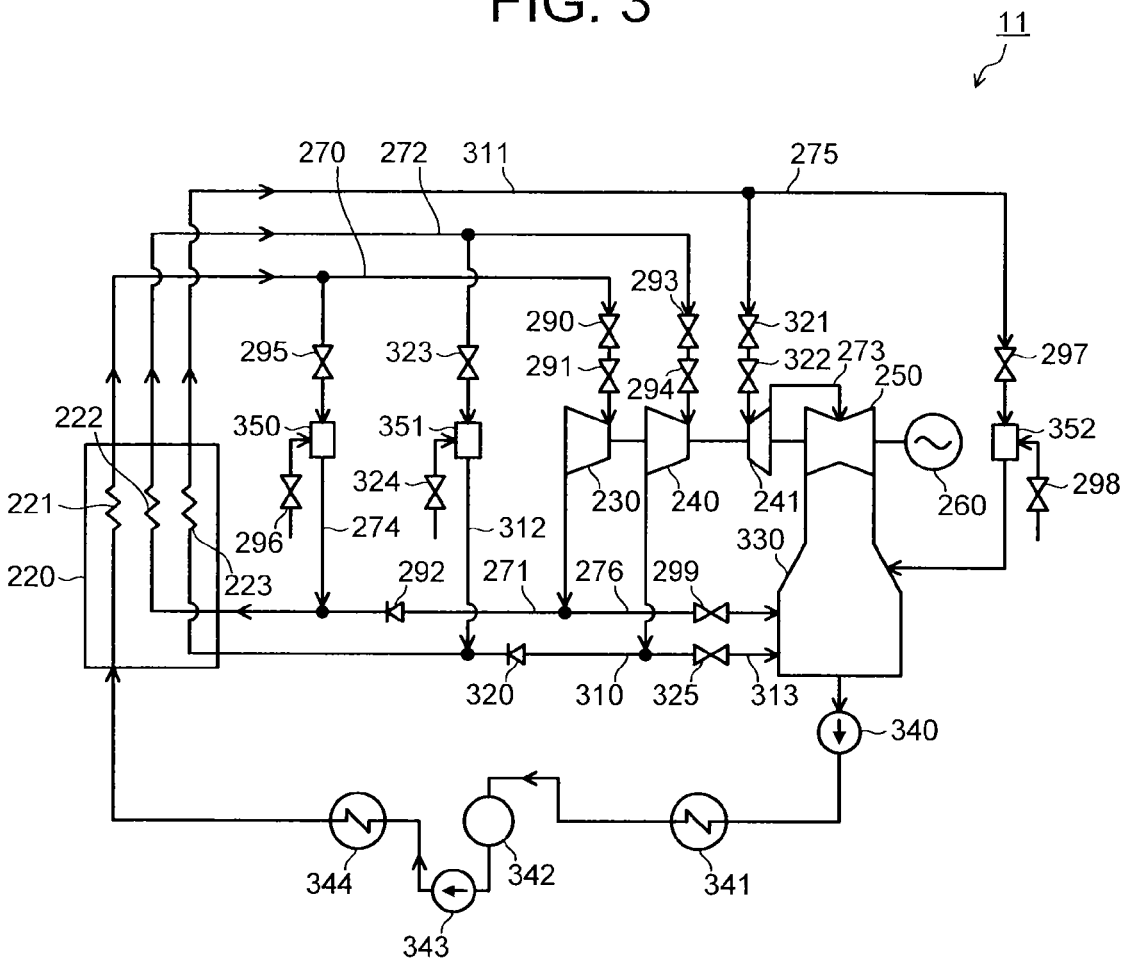
FIG. 3 is a system diagram of a steam turbine plant of a second embodiment.

FIG. 3 is a system diagram of a steam turbine plant 11 of a second embodiment. As shown in FIG. 3, main steam generated in a superheater 221 in a boiler 220 flows into a superhigh-pressure turbine 230 through a superhigh-pressure main steam stop valve 290 and a superhigh-pressure steam control valve 291 that are provided in a main steam pipe 270. The steam exhausted from the superhigh-pressure turbine 230 passes through a superhigh-pressure check valve 292 provided in a first low-temperature reheat steam pipe 271 and is led to a first reheater 222 in the boiler 220 to be reheated.

The reheated steam heated in the first reheater 222 flows into a first intermediate-pressure turbine 240 through a first reheat steam stop valve 293 and a first intercept valve 294 that are provided in a first high-temperature reheat steam pipe 272.

The steam exhausted from the first intermediate-pressure turbine 240 passes through a check valve 320 provided in a second low-temperature reheat steam pipe 310 and is led to a second reheater 223 in the boiler 220 to be reheated.

The reheated steam heated in the second reheater 223 flows into a second intermediate-pressure turbine 241 through a second reheat steam stop valve 321 and a second intercept valve 322 that are provided in a second high-temperature reheat steam pipe 311.

The steam exhausted from the second intermediate-pressure turbine 241 passes through a crossover pipe 273 to flow into a low-pressure turbine 250. A power generator 260 is coupled to a shaft end of the low-pressure turbine 250. The high-pressure turbine 230 and the first intermediate-pressure turbine 240 are coupled by a rotating shaft, the first intermediate-pressure turbine 240 and the second intermediate-pressure turbine 241 are coupled by a rotating shaft, and the second intermediate-pressure turbine 241 and the low-pressure turbine 250 are coupled by a rotating shaft, and the power generator 260 is driven by the high-pressure turbine 230, the first intermediate-pressure turbine 240, the second intermediate-pressure turbine 241, and the low-pressure turbine 250.

The steam exhausted from the low-pressure turbine 250 is led to a condenser 330 and is condensed to be condensed water. This condensed water is led to a low-pressure feed water heater 341 and a deaerator 342 by a condensate pump 340. Then, feed water that has passed through the deaerator 342 is pressurized by a feed water pump 343 and passes through a high-pressure feed water heater 344 to flow into the superheater 221 again.

Between the superheater 221 and the superhigh-pressure turbine 230, a bypass pipe 274 branches off the main steam pipe 270. The bypass pipe 274 functions as a superhigh-pressure turbine bypass pipe that bypasses the superhigh-pressure turbine 230 and is coupled to the first low-temperature reheat steam pipe 271. A branch portion where the bypass pipe 274 branches off the main steam pipe 270 is positioned upstream from the superhigh-pressure main steam stop valve 290 and the superhigh-pressure steam control valve 291. Incidentally, a coupling portion where the bypass pipe 274 is coupled to the first low-temperature reheat steam pipe 271 is downstream of the superhigh-pressure check valve 292 (on the first reheater 222 side).

Further, in the bypass pipe 274, a superhigh-pressure turbine bypass valve 295 and an attemperator 350 are provided. In a pipe through which cooling water is supplied to the attemperator 350, a cooling water regulating valve 296 that regulates a supply amount of cooling water is provided.

Between the first reheater 222 and the first intermediate-pressure turbine 240, a bypass pipe 312 branches off the first high-temperature reheat steam pipe 272. The bypass pipe 312 functions as an intermediate-pressure turbine bypass pipe that bypasses the first intermediate-pressure turbine 240 and is coupled to the second low-temperature reheat steam pipe 310. A branch portion where the bypass pipe 312 branches off the first high-temperature reheat steam pipe 272 is positioned upstream from the first reheat steam stop valve 293 and the first intercept valve 294. Incidentally, a coupling portion where the bypass pipe 312 is coupled to the second low-temperature reheat steam pipe 310 is downstream of the check valve 320 (on the second reheater 223 side).

Further, in the bypass pipe 312, an intermediate-pressure turbine bypass valve 323 and an attemperator 351 are provided. In a pipe through which cooling water is supplied to the attemperator 351, a cooling water regulating valve 324 that regulates a supply amount of cooling water is provided.

Between the second reheater 223 and the second intermediate-pressure turbine 241, a bypass pipe 275 branches off the second high-temperature reheat steam pipe 311. The bypass pipe 275 functions as a low-pressure turbine bypass pipe that bypasses the second intermediate-pressure turbine 241 and the low-pressure turbine 250 and is coupled to the condenser 330. A branch portion where the bypass pipe 275 branches off the second high-temperature reheat steam pipe 311 is positioned upstream from the second reheat steam stop valve 321 and the second intercept valve 322.

Further, in the bypass pipe 275, a low-pressure turbine bypass valve 297 and an attemperator 352 are provided. In a pipe through which cooling water is supplied to the attemperator 352, a cooling water regulating valve 298 that regulates a supply amount of cooling water is provided.

Between the superhigh-pressure turbine 230 and the first reheater 222, a branch pipe 276 branches off the first low-temperature reheat steam pipe 271. This branch pipe 276 functions as a first branch pipe and is coupled to the condenser 330. Incidentally, a branch portion where the branch pipe 276 branches off the first low-temperature reheat steam pipe 271 is upstream of the superhigh-pressure check valve 292 (on the superhigh-pressure turbine 230 side). Further, in the branch pipe 276, a first ventilator valve 299 is provided.

Between the first intermediate-pressure turbine 240 and the second reheater 223, a branch pipe 313 branches off the second low-temperature reheat steam pipe 310. This branch pipe 313 functions as a second branch pipe and is coupled to the condenser 330. Incidentally, a branch portion where the branch pipe 313 branches off the second low-temperature reheat steam pipe 310 is upstream of the check valve 320 (on the first intermediate-pressure turbine 240 side). Further, in the branch pipe 313, a second ventilator valve 325 is provided.

Further, in the steam turbine plant 11, a control device (not shown) that controls each of the valves and the like is provided in the same manner as the steam turbine plant 10 of the first embodiment.

Next, a driving method of the steam turbine plant 11 will be explained.

Figure 4:
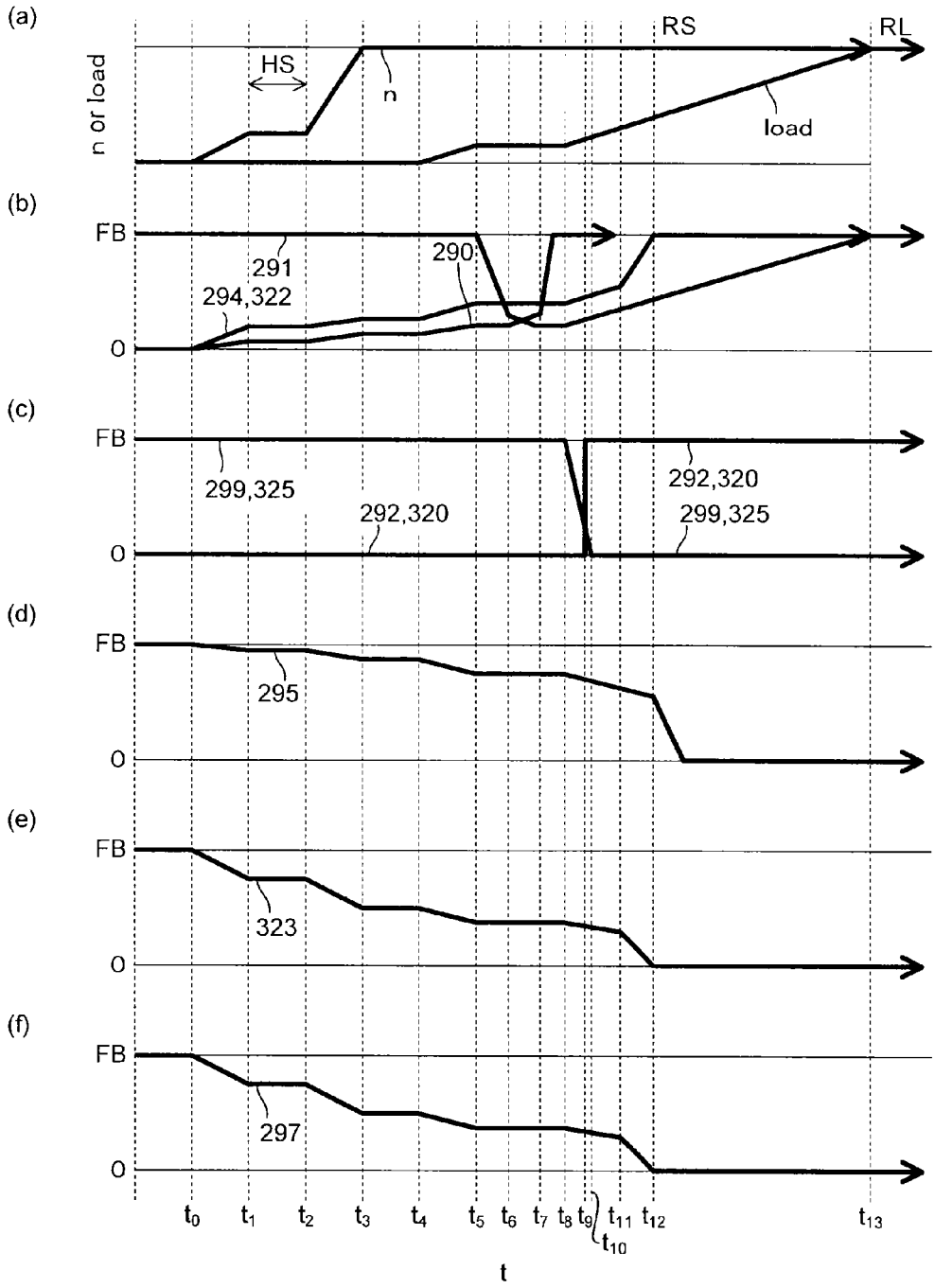
FIG. 4 is a view showing the relationship between a turbine rotation speed and a load and an opening degree of each valve at the time of steam turbine start up in the steam turbine plant of the second embodiment.

FIG. 4 is a view showing the relationship between a turbine rotation speed and a load and an opening degree of each valve at the time of steam turbine start up in the steam turbine plant 11 of the second embodiment. In FIG. 4, the horizontal axis is a time t and $t_0$ to $t_{13}$ each indicate a point of time. Then, at (a), the vertical axis indicates a turbine rotation speed n and a load (load). At (b), the vertical axis indicates the opening degrees of the superhigh-pressure main steam stop valve 290, the superhigh-pressure steam control valve 291, the first intercept valve 294, and the second intercept valve 322. At (c), the vertical axis indicates the opening degrees of the first ventilator valve 299, the second ventilator valve 325, the superhigh-pressure check valve 292, and the check valve 320. At (d), the vertical axis indicates the opening degree of the superhigh-pressure turbine bypass valve 295. At (e), the vertical axis indicates the opening degree of the intermediate-pressure turbine bypass valve 323. At (f), the vertical axis indicates the opening degree of the low-pressure turbine bypass valve 297. Incidentally, as for the vertical axis from (b) to (t), "FB" indicates that the valve is fully opened and "0" indicates that the valve is fully closed.

Incidentally, in the steam turbine plant 11 of the second embodiment, steam is circulated into the superhigh-pressure turbine 230, the first intermediate-pressure turbine 240, and the second intermediate-pressure turbine 241 simultaneously at the time of steam turbine start up. In an acceleration process of the steam turbine, the turbine rotation speed n is increased to a previously set target speed. Further, hereinafter, each of the valves is controlled by the above-described control device.

In the second embodiment, the first intercept valve 294 and the second intercept valve 322 perform the same operation simultaneously. Further, the first ventilator valve 299 and the second ventilator valve 325 perform the same operation simultaneously.

Prior to $t_0$, the first reheat steam stop valve 293 and the second reheat steam stop valve 321 are brought into a fully opened state by a reset operation of the steam turbine, which is not shown. Further, the superhigh-pressure turbine bypass valve 295, the intermediate-pressure turbine bypass valve 323, and the low-pressure turbine bypass valve 297 are brought into a fully opened state, and turbine bypass driving is started.

At $t_0$, a sub valve (child valve) built in the superhigh-pressure main steam stop valve 290 is gradually opened from a fully closed state (see (b) in FIG. 4). At this time, the superhigh-pressure turbine bypass valve 295 is gradually closed from a fully opened state (see (d) in FIG. 4). Then, the main steam flows into the superhigh-pressure turbine 230 and the superhigh-pressure turbine 230 starts (see FIG. 3).

Further, at $t_0$, the first intercept valve 294 and the second intercept valve 322 are gradually opened from a fully closed state (see (b) in FIG. 4). At this time, the intermediate-pressure turbine bypass valve 323 and the low-pressure turbine bypass valve 297 are gradually closed from a fully opened state (see (e) and (f) in FIG. 4). Then, the reheated steam flows into the first intermediate-pressure turbine 240 and the second intermediate-pressure turbine 241 (see FIG. 3) and the steam flows from the sub valve of the superhigh-pressure main steam stop valve 290, the first intercept valve 294, and the second intercept valve 322, to thereby increase the turbine rotation speed n (see (a) in FIG. 4).

Further, at $t_0$, the superhigh-pressure steam control valve 291 is in a fully opened state in order to correspond to full arc admission by the sub valve of the superhigh-pressure main steam stop valve 290 (see (b) in FIG. 4). Incidentally, the superhigh-pressure check valve 292 and the check valve 320 are in a fully closed state (see (c) in FIG. 4). Then, the first ventilator valve 299 and the second ventilator valve 325 are in a fully opened state (see (c) in FIG. 4). Then, from $t_0$ to $t_1$, the superhigh-pressure main steam stop valve 290, the first intercept valve 294, and the second intercept valve 322 are gradually opened (see (c) in FIG. 4) to increase the turbine rotation speed n to the set target rotation speed (see (a) in FIG. 4). Here, the control device, based on information of the turbine rotation speed n, performs control from $t_0$ to $t_1$ until the turbine rotation speed n reaches the set target rotation speed.

Incidentally, the structures of the first intercept valve 294, the second intercept valve 322, the first reheat steam stop valve 293, and the second reheat steam stop valve 321 are the same as those of the intercept valve 94 and the reheat steam stop valve 93 in the first embodiment.

Next, from $t_1$ to $t_2$, the turbine rotation speed n is kept to the set target rotation speed, heat soak driving HS is set, and warming up of a steam turbine main body is performed (see (a) in FIG. 4). In this occasion, the control device, when detecting that the turbine rotation speed n has reached the set target rotation speed, keeps the opening degrees of the sub valve of the superhigh-pressure main steam stop valve 290, the first intercept valve 294, and the second intercept valve 322 constant (see (b) in FIG. 4), to thereby keep the turbine rotation speed n constant. Further, the opening degrees of the superhigh-pressure steam control valve 291, the superhigh-pressure turbine bypass valve 295, the intermediate-pressure turbine bypass valve 323, and the low-pressure turbine bypass valve 297 are also kept constant (see (b), (d), (e), and (f) in FIG. 4). Here, the control device, when judging that the turbine rotation speed n has reached the set target rotation speed, based on information of the turbine rotation speed n, performs control from $t_1$ to $t_2$.

Incidentally, the control device, when judging that temperatures of component parts of the steam turbine have reached predetermined temperatures based on information of temperatures of the component parts (for example, a nozzle box, the main steam stop valve 90, the steam control valve 91, and the like) and the like of the steam turbine, for example, determines that the heat soak driving HS has been completed, namely the warming up driving has been completed.

After completion of the heat soak driving HS, from $t_2$ to $t_3$, the superhigh-pressure main steam stop valve 290, the first intercept valve 294, and the second intercept valve 322 are gradually opened (see (b) in FIG. 4), to thereby increase the turbine rotation speed n to a previously set rated rotation speed RS. In order to increase the amount of steam to flow into each of the steam turbines, the superhigh-pressure turbine bypass valve 295, the intermediate-pressure turbine bypass valve 323, and the low-pressure turbine bypass valve 297 are gradually closed (see (d) and (e) in FIG. 4) to regulate pressures on the upstream side of these bypass valves. Here, the control device performs control from $t_2$ to $t_3$ until the turbine rotation speed n is increased to the rated rotation speed RS, based on information of the turbine rotation speed n, for example, (see (a) in FIG. 4).

After the turbine rotation speed n is increased to the rated rotation speed RS, from $t_3$ to $t_4$, the opening degree of the first intercept valve 294 and the opening degree of the second intercept valve 322 are kept constant and the opening degree of the sub valve of the superhigh-pressure main steam stop valve 290 is regulated slightly, and equal speed driving is performed and an operation of parallel combination into an electric system is performed (see (b) in FIG. 4). Here, the control device, when judging that the turbine rotation speed n has been increased to the rated rotation speed RS, based on information of the turbine rotation speed n, for example, performs control from $t_3$ to $t_4$. Further, in the operation of the parallel combination into the electric system, the control device, with reference to a system frequency, for example, regulates the superhigh-pressure main steam stop valve 290 to perform slight regulation of the turbine rotation speed n.

In this occasion, the opening degrees of the superhigh-pressure steam control valve 291, the superhigh-pressure turbine bypass valve 295, the intermediate-pressure turbine bypass valve 323, and the low-pressure turbine bypass valve 297 are kept constant (see (b), (d), (e), and (f) in FIG. 4).

After the parallel combination into the electric system, from $t_4$ to $t_5$, the opening degrees of the sub valve of the superhigh-pressure main steam stop valve 290, the first intercept valve 294, and the second intercept valve 322 are gradually opened (see (b) in FIG. 4) and load driving is performed until an initial load (see (a) in FIG. 4). In order to increase the steam to flow into each of the steam turbines, the superhigh-pressure turbine bypass valve 295, the intermediate-pressure turbine bypass valve 323, and the low-pressure turbine bypass valve 297 are gradually closed (see (d), (e), and (f) in FIG. 4) to regulate pressures on the upstream side of these bypass valves.

Here, the control device, when judging that the parallel combination into the electric system has been completed, based on pieces of information of frequencies, voltages, phases, and the like of the electric system and the power generator, for example, performs control from $t_4$ to $t_5$.

After reaching the initial load, from $t_5$ to $t_8$, the full arc admission by the sub valve of the superhigh-pressure main steam stop valve 290 is switched to partial arc admission by the superhigh-pressure steam control valve 291 while the load is kept constant (see (b) in FIG. 4). In this period, the opening degrees of the first intercept valve 294, the second intercept valve 322, the superhigh-pressure turbine bypass valve 295, the intermediate-pressure turbine bypass valve 323, the low-pressure turbine bypass valve 297, the first ventilator valve 299, and the second ventilator valve 325 are kept constant (see (b) to (f) in FIG. 4).

Here, operations from $t_5$ to $t_8$ will be explained in detail.

From $t_5$ to $t_8$, the fully opened superhigh-pressure steam control valve 291 is gradually closed while the opening degree of the sub valve of the superhigh-pressure main steam stop valve 290 is kept constant (see (b) in FIG. 4). At a point of time of $t_5$, the steam to flow into the superhigh-pressure turbine 230 (see FIG. 3) is controlled by the sub valve of the superhigh-pressure main steam stop valve 290. Then, at a point of time of $t_6$, the superhigh-pressure steam control valve 291 is opened rather than the sub valve of the superhigh-pressure main steam stop valve 290 so as to have a large flow rate (see (b) in FIG. 4).

Further, from $t_6$ to $t_7$, the sub valve of the superhigh-pressure main steam stop valve 290 is gradually opened while the superhigh-pressure steam control valve 291 is being closed (see (b) in FIG. 4). In this period, a valve that regulates the steam to flow into the superhigh-pressure turbine 230 (see FIG. 3) is switched to the superhigh-pressure steam control valve 291 from the sub valve of the superhigh-pressure main steam stop valve 290.

Therefore, the flow rate of the steam to flow from the sub valve of the superhigh-pressure main steam stop valve 290 at $t_6$ and the flow rate of the steam to flow from the superhigh-pressure steam control valve 291 at $t_7$ are set to be the same. Then, at and after $t_7$, the flow rate of the steam to flow into the superhigh-pressure turbine 230 (see FIG. 3) is regulated by the superhigh-pressure steam control valve 291. From $t_7$ to $t_8$, the sub valve of the superhigh-pressure main steam stop valve 290 is fully opened, and subsequently the superhigh-pressure main steam stop valve 290 itself is fully opened (see (b) in FIG. 4). In this manner, the operation of switching from the full arc admission to the partial arc admission is completed.

In this manner, the control device, when judging that the load has reached the previously set initial load, based on information of the load, for example, performs controls from $t_5$ to $t_8$. From $t_5$ to $t_8$, the control device controls the opening degrees of the sub valve of the superhigh-pressure main steam stop valve 290, the superhigh-pressure steam control valve 291, the first intercept valve 294, the second intercept valve 322, the superhigh-pressure turbine bypass valve 295, the intermediate-pressure turbine bypass valve 323, the low-pressure turbine bypass valve 297, and the like based on information of the load, for example, in order to keep the load and the turbine rotation speed n constant.

From $t_8$ to $t_{11}$, in order to prevent falling of the load, there is performed cooperative control in which in conjunction with an operation of opening the superhigh-pressure steam control valve 291 and the first intercept valve 294 (see (b) and (c) in FIG. 4), an operation of closing the first ventilator valve 299 and the second ventilator valve 325 is performed, and the first ventilator valve 299 and the second ventilator valve 325 are brought into a fully closed state finally (see (c) in FIG. 4). While the opening degrees of the first ventilator valve 299, the second ventilator valve 325, the superhigh-pressure steam control valve 291, and the first intercept valve 294 are controlled in conjunction with one another, the superhigh-pressure steam control valve 291, the first intercept valve 294, and the second intercept valve 322 are controlled, and thereby the turbine rotation speed n is controlled and the turbine load is increased (see (a) in FIG. 4). With this increase in the load, the superhigh-pressure turbine bypass valve 295, the intermediate-pressure turbine bypass valve 323, and the low-pressure turbine bypass valve 297 are gradually closed (see (d), (e), and (f) in FIG. 4).

Here, the first ventilator valve 299 approaches a fully closed state, and thereby pressure in an exhaust hood of the superhigh-pressure turbine 230 (see FIG. 3), namely pressure on the upstream side of the superhigh-pressure check valve 292 (on the superhigh-pressure turbine 230 side) increases. Further, the second ventilator valve 325 approaches a fully closed state, and thereby pressure in an exhaust hood of the first intermediate-pressure turbine 240, namely pressure on the upstream side of the check valve 320 (on the first intermediate-pressure turbine 240 side) increases.

Further, at $t_9$, the pressure on the upstream side of the superhigh-pressure check valve 292 becomes higher from a state where the pressure on the upstream side of the superhigh-pressure check valve 292 and the pressure on the downstream side of the superhigh-pressure check valve 292 (namely, pressure at an entrance of the first reheater 222) are the same. Therefore, the superhigh-pressure check valve 292 is fully opened at once (see (c) in FIG. 4). When the superhigh-pressure check valve 292 is fully opened, the whole steam that has passed through the exhaust hood of the superhigh-pressure turbine 230 flows into the first reheater 222 because the first ventilator valve 299 is in a nearly closed state. Further, the pressure on the upstream side of the check valve 320 becomes higher from a state where the pressure on the upstream side of the check valve 320 and the pressure on the downstream side of the check valve 320 (namely, pressure at an entrance of the second reheater 223) are the same. Therefore, the check valve 320 is fully opened at once. When the check valve 320 is fully opened, the whole steam that has passed through the exhaust hood of the first intermediate-pressure turbine 240 flows into the second reheater 223 because the second ventilator valve 325 is in a nearly closed state.

Further, from $t_9$ to $t_{11}$, the superhigh-pressure steam control valve 291, the first intercept valve 294, and the second intercept valve 322 are controlled (see (b) in FIG. 4), to thereby increase the turbine load (see (a) in FIG. 4). At $t_{10}$, the first ventilator valve 299 and the second ventilator valve 325 are brought into a fully closed state. Incidentally, at $t_{10}$, with the first ventilator valve 299 and the second ventilator valve 325 being brought into a fully closed state, a heat drop of expansion decreases in the superhigh-pressure turbine 230 and the first intermediate-pressure turbine 240 (see FIG. 3). For this reason, effective work is slightly decreased at rotor blades of the superhigh-pressure turbine 230 and the first intermediate-pressure turbine 240. However, outputs of the second intermediate-pressure turbine 241 and the low-pressure turbine 250 each having a large load shearing ratio are dominant, so that a load characteristic is not affected.

Here, the control device, when detecting that the superhigh-pressure main steam stop valve 290 has been brought into a fully opened state and judging that the full arc admission by the superhigh-pressure main steam stop valve 290 has been completed, for example, performs controls at and after $t_8$.

From $t_{11}$ to $t_{12}$, with the increase in the load (see (a) in FIG. 4), the superhigh-pressure steam control valve 291, the first intercept valve 294, and the second intercept valve 322 are gradually opened (see (b) in FIG. 4). At $t_{11}$, however, the opening degrees of the first intercept valve 294 and the second intercept valve 322 are already in a high state and a change in flow rate relative to the opening degree of the valve is small. Therefore, an inclination of a valve opening characteristic of the first intercept valve 294 and the second intercept valve 322 is increased to make the first intercept valve 294 and the second intercept valve 322 fully open at $t_{12}$.

Further, from $t_{11}$ to $t_{12}$, the pressures on the upstream side of the first intercept valve 294 and the second intercept valve 322 increase to a set value of pressure control of the intermediate-pressure turbine bypass valve 323 and the low-pressure turbine bypass valve 297. For this reason, with an operation of opening the first intercept valve 294 and the second intercept valve 322 (see (b) in FIG. 4), the intermediate-pressure turbine bypass valve 323 and the low-pressure turbine bypass valve 297 are brought into a fully closed state at $t_{12}$ (see (e) and (f) in FIG. 4) and the pressure control is completed. Even though, simultaneously with this control, the first intercept valve 294 and the second intercept valve 322 are brought into a fully opened state, the pressures on the upstream side of the first intercept valve 294 and the second intercept valve 322 hardly change. For this reason, the load characteristic is not affected.

Here, the control device performs control from $t_{11}$ to $t_{12}$ based on a request to increase the load.

From $t_{12}$ to $t_{13}$, with the increase in the load, the superhigh-pressure steam control valve 291 is only used for all the controls of the load to be performed at and after $t_{12}$. Then, at $t_{13}$, the superhigh-pressure steam control valve 291 is brought into a fully opened state and the turbine load reaches a rated load RL.

Incidentally, in the middle from $t_{12}$ to $t_{13}$, capacity of the superhigh-pressure turbine bypass valve 295 is restricted, so that with an operation of opening the superhigh-pressure steam control valve 291, the superhigh-pressure turbine bypass valve 295 is brought into a fully closed state and the pressure control is completed.

Here, the control device, when detecting that the intermediate-pressure turbine bypass valve 323 and the low-pressure turbine bypass valve 297 have been brought into a fully closed state and the first intercept valve 294 and the second intercept valve 322 have been brought into a fully opened state, performs control from $t_{12}$ to $t_{13}$.

Next, there will be explained a driving operation when the superhigh-pressure steam control valve 291 is brought into a fully closed state due to some reason or other at the time of turbine start up and/or during load driving.

In this case, supplying steam to the superhigh-pressure turbine 230 is stopped and the superhigh-pressure check valve 292 is brought into a fully closed state. When this state continues, the temperature of the exhaust hood of the superhigh-pressure turbine 230 is increased due to windage loss, and thus a dangerous state is caused.

Thus, when at the time of turbine start up and/or during load driving, the superhigh-pressure steam control valve 291 is brought into a fully closed state due to some reason or other and further the superhigh-pressure check valve 292 is brought into a fully closed state, the control device opens the first ventilator valve 299. Thereby, the exhaust hood of the superhigh-pressure turbine 230 is communicated with the condenser 330 to be brought into a vacuum state. For this reason, it is possible to prevent the temperature of the exhaust hood of the superhigh-pressure turbine 230 from being increased by windage loss.

Further, when at the time of turbine start up and/or during load driving, the first intercept valve 294 is brought into a fully closed state due to some reason or other, a driving operation to be described below is performed.

In this case, supplying steam to the first intermediate-pressure turbine 240 is stopped and the check valve 320 is brought into a fully closed state. When this state continues, the temperature of the exhaust hood of the first intermediate-pressure turbine 240 is increased due to windage loss, and thus a dangerous state is caused.

Thus, when at the time of turbine start up and/or during load driving, the first intercept valve 294 is brought into a fully closed state due to some reason or other and further the check valve 320 is brought into a fully closed state, the control device opens the second ventilator valve 325. Thereby, the exhaust hood of the first intermediate-pressure turbine 240 is communicated with the condenser 330 to be brought into a vacuum state. For this reason, it is possible to prevent the temperature of the exhaust hood of the first intermediate-pressure turbine 240 from being increased by windage loss.

Incidentally, one example where the full arc admission by the sub valve is performed in the superhigh-pressure main steam stop valve 290 has been described, but the present invention is not limited to this. For example, it is also possible to make a large-sized reheat steam turbine such that a servomotor to be controlled by the control device is provided with each of the plural superhigh-pressure steam control valves 291 operate similarly to the first embodiment.

According to the steam turbine plant 11 of the second embodiment, it is possible to supply steam to all the superhigh-pressure turbine 230, the first intermediate-pressure turbine 240, and the second intermediate-pressure turbine 241 simultaneously at the time of start up of the steam turbine. That is, it is possible to warm up the superhigh-pressure turbine 230, the first intermediate-pressure turbine 240, and the second intermediate-pressure turbine 241 simultaneously. For this reason, it is possible to shorten a start-up time.

Further, in this embodiment, in the branch pipe 276 between the exhaust hood of the superhigh-pressure turbine 230 and the condenser 330, the first ventilator valve 299 is provided. For this reason, opening the first ventilator valve 299 makes it possible to vacuumize the exhaust hood of the superhigh-pressure turbine 230. Further, in this embodiment, in the branch pipe 313 between the exhaust hood of the first intermediate-pressure turbine 240 and the condenser 330, the second ventilator valve 325 is provided. For this reason, opening the second ventilator valve 325 makes it possible to vacuumize the exhaust hood of the first intermediate-pressure turbine 240.

This thereby makes it possible to prevent the temperature of the exhaust hood of the superhigh-pressure turbine 230 from being increased by windage loss even when the superhigh-pressure steam control valve 291 is brought into a fully closed state and further the superhigh-pressure check valve 292 is brought into a fully closed state at the time of turbine start up and/or during load driving, for example. Further, it is possible to prevent the temperature of the exhaust hood of the first intermediate-pressure turbine 240 from being increased by windage loss even when the first intercept valve 294 is brought into a fully closed state and further the check valve 320 is brought into a fully closed state at the time of turbine start up and/or during load driving.

Third Embodiment

In a third embodiment, there will be explained one example of a driving method in which in the steam turbine plant 11 of the second embodiment, the first intercept valve 294, the second intercept valve 322, the first ventilator valve 299, and the second ventilator valve 325 are each controlled separately.

Figure 5:
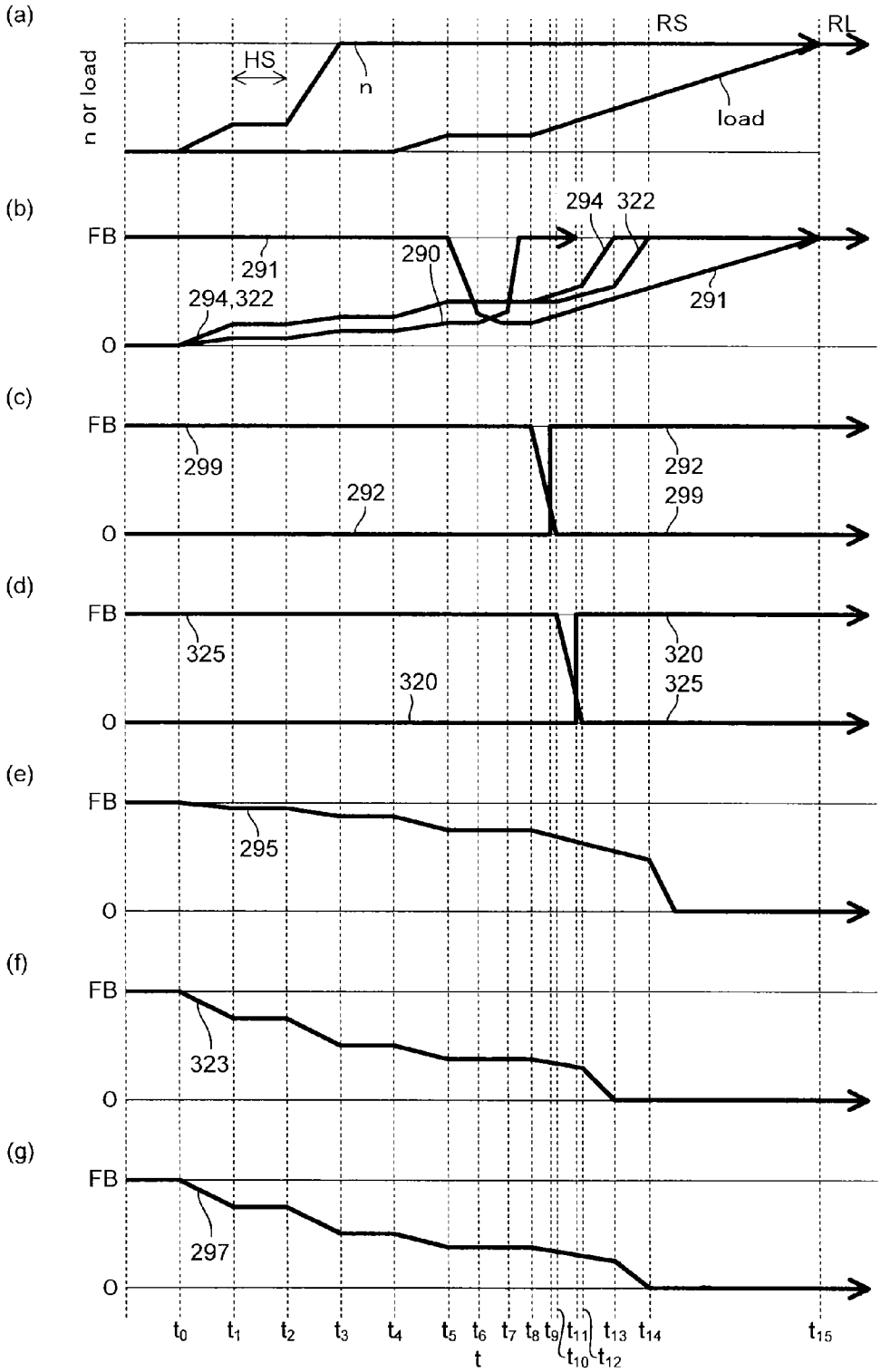
FIG. 5 a view showing the relationship between a turbine rotation speed and a load and an opening degree of each valve at the time of steam turbine start up in a steam turbine plant of a third embodiment.
Figure 6:
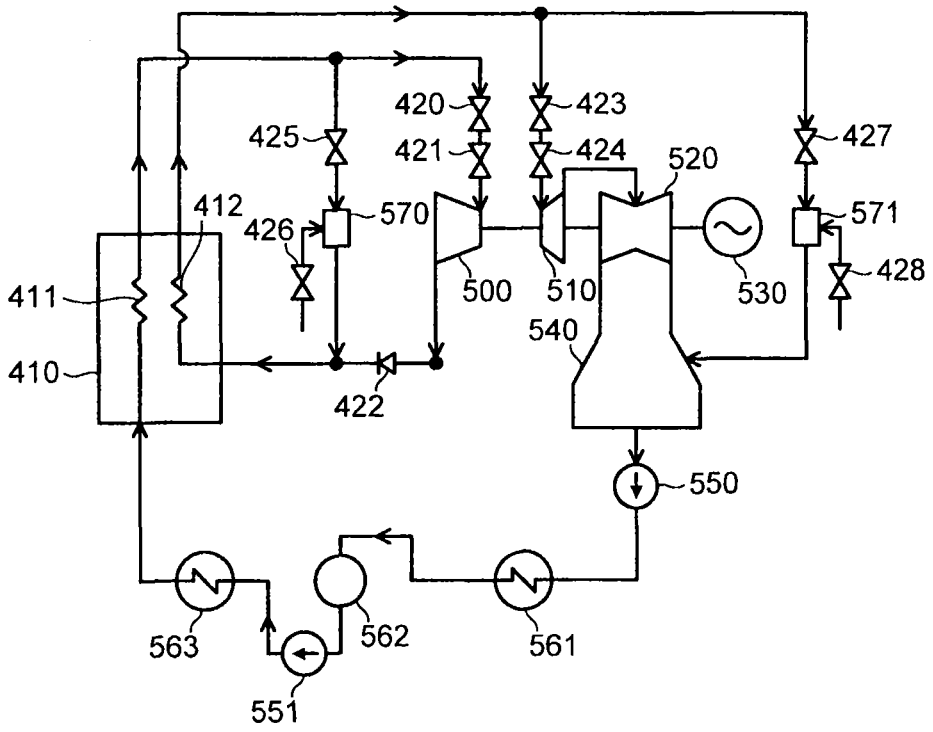
FIG. 6 is a system diagram of a steam turbine plant provided with a conventional turbine bypass system.
Figure 7:
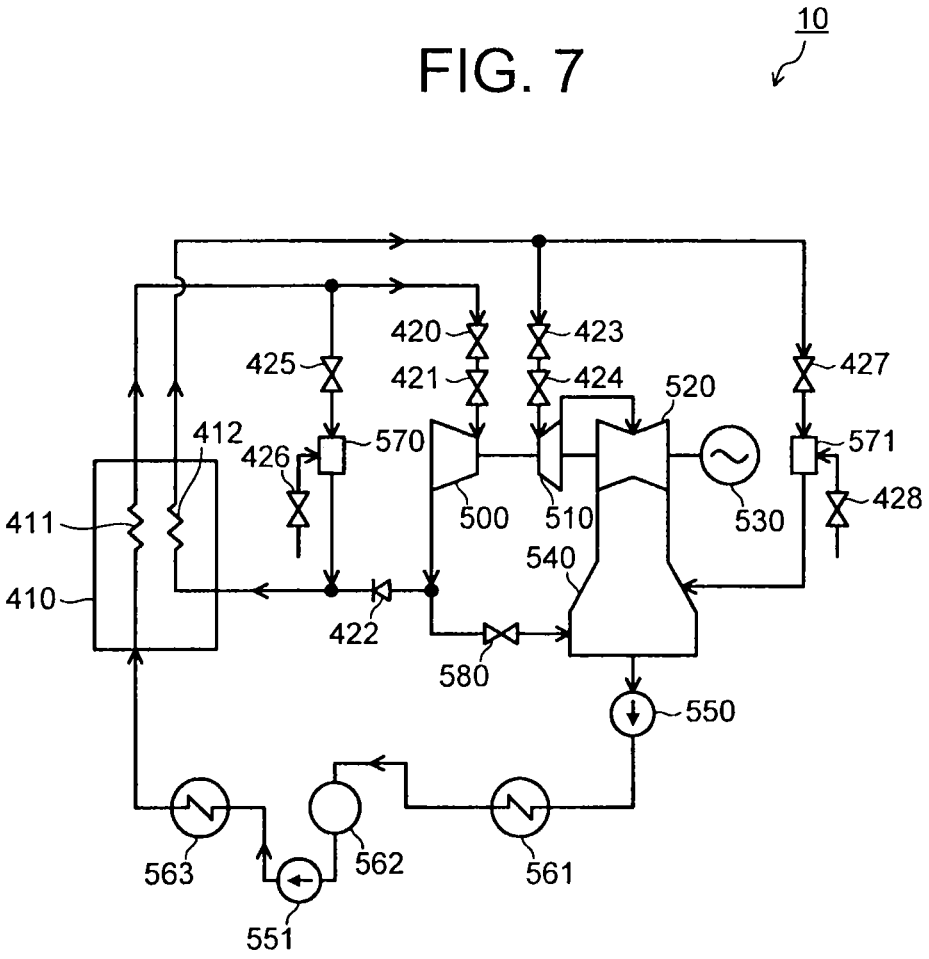
FIG. 7 is a system diagram of a steam turbine plant provided with a conventional turbine bypass system.

FIG. 5 is a view showing the relationship between a turbine rotation speed and a load and an opening degree of each valve at the time of steam turbine start up in the steam turbine plant 11 of the third embodiment. In FIG. 5, the horizontal axis is a time t and $t_0$ to $t_{15}$ each indicate a point of time. Then, at (a), the vertical axis indicates a turbine rotation speed n and a load (load). At (b), the vertical axis indicates the opening degrees of the superhigh-pressure main steam stop valve 290, the superhigh-pressure steam control valve 291, the first intercept valve 294, and the second intercept valve 322. At (c), the vertical axis indicates the opening degrees of the first ventilator valve 299 and the superhigh-pressure check valve 292. At (d), the vertical axis indicates the opening degrees of the second ventilator valve 325 and the check valve 320. At (e), the vertical axis indicates the opening degree of the superhigh-pressure turbine bypass valve 295. At (f), the opening degree of the intermediate-pressure turbine bypass valve 323 is shown. At (g), the opening degree of the low-pressure turbine bypass valve 297 is shown. Incidentally, as for the vertical axis from (b) to (g), "FB" indicates that the valve is fully opened and "0" indicates that the valve is fully closed.

Incidentally, in the steam turbine plant 11 of the third embodiment, at the time of steam turbine start up, steam is circulated into the superhigh-pressure turbine 230, the first intermediate-pressure turbine 240, and the second intermediate-pressure turbine 241 simultaneously. In an acceleration process of the steam turbine, the turbine rotation speed n is increased to a previously set target speed. Further, hereinafter, each of the valves is controlled by the above-described control device.

Here, in the driving method of the steam turbine plant 11 of the third embodiment, operations from t0 to t8 are the same as those of the driving method of the steam turbine plant 11 of the second embodiment (see FIG. 4). Therefore, their explanations are omitted.

From $t_8$ to $t_{10}$, in order to prevent falling of the load, there is performed cooperative control in which in conjunction with an operation of opening the superhigh-pressure steam control valve 291 (see (b) in FIG. 5), an operation of closing the first ventilator valve 299 is performed, and the first ventilator valve 299 is brought into a fully closed state finally (see (c) in FIG. 5). While the opening degree of the first ventilator valve 299 and the opening degree of the superhigh-pressure steam control valve 291 are controlled in conjunction with each other, the opening degrees of the superhigh-pressure steam control valve 291 and the first intercept valve 294 are controlled. Thereby, the turbine rotation speed n is controlled and the turbine load is increased (see (a) in FIG. 5). With this increase in the load, the superhigh-pressure turbine bypass valve 295, the intermediate-pressure turbine bypass valve 323, and the low-pressure turbine bypass valve 297 are gradually closed (see (f) and (g) in FIG. 5).

Here, the first ventilator valve 299 approaches a fully closed state, and thereby pressure in the exhaust hood of the superhigh-pressure turbine 230, namely pressure on the upstream side of the superhigh-pressure check valve 292 (on the superhigh-pressure turbine 230 side) increases.

Further, at $t_9$, the pressure on the upstream side of the superhigh-pressure check valve 292 becomes higher from a state where the pressure on the upstream side of the superhigh-pressure check valve 292 and the pressure on the downstream side of the superhigh-pressure check valve 292 (namely, pressure at an entrance of the first reheater 222) are the same. Therefore, the superhigh-pressure check valve 292 is fully opened at once (see (c) in FIG. 5). When the superhigh-pressure check valve 292 is fully opened, the whole steam that has passed through the exhaust hood of the superhigh-pressure turbine 230 flows into the first reheater 222 because the first ventilator valve 299 is in a nearly closed state. Incidentally, at $t_{10}$, the first ventilator valve 299 is brought into a fully closed state (see (c) in FIG. 5).

From $t_{10}$ to $t_{12}$, in order to prevent falling of the load, there is performed cooperative control in which in conjunction with an operation of opening the first intercept valve 294, an operation of closing the second ventilator valve 325 is performed, and the second ventilator valve 325 is brought into a fully closed state finally (see (b) and (d) in FIG. 5). While the opening degrees of the second ventilator valve 325 and the first intercept valve 294 are controlled in conjunction with each other, the superhigh-pressure steam control valve 291, the first intercept valve 294, and the second intercept valve 322 are controlled (see (b) in FIG. 5). Thereby, the turbine rotation speed n is controlled and the turbine load is increased. With this increase in the load, the superhigh-pressure turbine bypass valve 295, the intermediate-pressure turbine bypass valve 323, and the low-pressure turbine bypass valve 297 are gradually closed (see (e), (f), and (g) in FIG. 5).

Here, the second ventilator valve 325 approaches a fully closed state, and thereby pressure in the exhaust hood of the first intermediate-pressure turbine 240, namely pressure on the upstream side of the check valve 320 (on the first intermediate-pressure turbine 240 side) increases.

Further, at $t_{11}$, the pressure on the upstream side of the check valve 320 becomes higher from a state where the pressure on the upstream side of the check valve 320 and the pressure on the downstream side of the check valve 320 (namely, pressure at an entrance of the second reheater 223) are the same. Therefore, the check valve 320 is fully opened at once (see (d) in FIG. 5). When the check valve 320 is fully opened, the whole steam that has passed through the exhaust hood of the first intermediate-pressure turbine 240 flows into the second reheater 223 because the second ventilator valve 325 is in a nearly closed state. Incidentally, at $t_{12}$, the second ventilator valve 325 is brought into a fully closed state (see (d) in FIG. 5).

Further, from $t_8$ to $t_{12}$, the superhigh-pressure steam control valve 291, the first intercept valve 294, and the second intercept valve 322 are controlled (see (b) in FIG. 5), to thereby increase the turbine load (see (a) in FIG. 5). With this increase in the load, the superhigh-pressure turbine bypass valve 295, the intermediate-pressure turbine bypass valve 323, and the low-pressure turbine bypass valve 297 are gradually closed (see (e), (f), and (g) in FIG. 5).

Incidentally, with the first ventilator valve 299 and the second ventilator valve 325 being brought into a fully closed state, a heat drop of expansion decreases in the superhigh-pressure turbine 230 and the first intermediate-pressure turbine 240. For this reason, effective work is slightly decreased at rotor blades of the superhigh-pressure turbine 230 and the first intermediate-pressure turbine 240. However, outputs of the second intermediate-pressure turbine 241 and the low-pressure turbine 250 each having a large load shearing ratio are dominant, so that a load characteristic is not affected.

Here, the control device, when detecting that the superhigh-pressure main steam stop valve 290 has been brought into a fully opened state and judging that the full arc admission by the superhigh-pressure main steam stop valve 290 has been completed, for example, performs controls at and after $t_8$.

From $t_{12}$ to $t_{13}$, with the increase in the load (see (a) in FIG. 5), the superhigh-pressure steam control valve 291, the first intercept valve 294, and the second intercept valve 322 are gradually opened (see (b) in FIG. 5). At $t_{12}$, however, the opening degree of the first intercept valve 294 is already in a high state and a change in flow rate relative to the opening degree is small. Therefore, an inclination of a valve opening characteristic of the first intercept valve 294 is increased to make the first intercept valve 294 fully open at $t_{13}$. Incidentally, the inclination of a valve opening characteristic of the second intercept valve 322 from $t_{12}$ to $t_{13}$ is not allowed to be changed.

Further, from $t_{12}$ to $t_{13}$, the pressure on the upstream side of the first intercept valve 294 increases to a set value of pressure control of the intermediate-pressure turbine bypass valve 323. For this reason, with an operation of opening the first intercept valve 294 (see (b) in FIG. 5), the intermediate-pressure turbine bypass valve 323 is brought into a fully closed state at $t_{13}$ (see (f) in FIG. 5) and the pressure control is completed. Even though, simultaneously with this control, the first intercept valve 294 is brought into a fully opened state, the pressure on the upstream side of the first intercept valve 294 hardly changes. For this reason, the load characteristic is not affected.

Here, the control device performs control from $t_{12}$ to $t_{13}$ based on a request to increase the load.

From $t_{13}$ to $t_{14}$, with the increase in the load (see (a) in FIG. 5), the superhigh-pressure steam control valve 291 and the second intercept valve 322 are gradually opened (see (b) in FIG. 5). At $t_{13}$, however, the opening degree of the second intercept valve 322 is already in a high state and a change in flow rate relative to the opening degree is small. Therefore, an inclination of a valve opening characteristic of the second intercept valve 322 is increased to make the second intercept valve 322 fully open at $t_{14}$.

Further, from $t_{13}$ to $t_{14}$, the pressure on the upstream side of the second intercept valve 322 increases to a set value of pressure control of the low-pressure turbine bypass valve 297. For this reason, with an operation of opening the second intercept valve 322 (see (b) in FIG. 5), the low-pressure turbine bypass valve 297 is brought into a fully closed state at $t_{14}$ (see (g) in FIG. 5) and the pressure control is completed. Even though, simultaneously with this control, the second intercept valve 322 is brought into a fully opened state, the pressure on the upstream side of the second intercept valve 322 hardly changes. For this reason, the load characteristic is not affected.

Here, the control device detects that the intermediate-pressure turbine bypass valve 323 has been brought into a fully closed state and the first intercept valve 294 has been brought into a fully opened state and based on a request to increase the load, performs control from $t_{13}$ to $t_{14}$.

From $t_{14}$ to $t_{45}$, with the increase in the load, the superhigh-pressure steam control valve 291 is only used for all the controls of the load to be performed at and after $t_{14}$. Then, at $t_{15}$, the superhigh-pressure steam control valve 291 is brought into a fully opened state and the turbine load reaches a rated load RL.

Incidentally, in the middle from $t_{14}$ to $t_{15}$, capacity of the superhigh-pressure turbine bypass valve 295 is restricted, so that with an operation of opening the superhigh-pressure steam control valve 291, the superhigh-pressure turbine bypass valve 295 is brought into a fully closed state and the pressure control is completed.

Here, the control device detects that the low-pressure turbine bypass valve 297 has been brought into a fully closed state and the second intercept valve 322 has been brought into a fully opened state and based on a request to increase the load, performs control from $t_{14}$ to $t_{15}$.

Incidentally, according to the third embodiment of the present invention as well, when the superhigh-pressure steam control valve 291 and the first intercept valve 294 are fully closed at the time of turbine start up and/or during load driving, the first ventilator valve 299 and the second ventilator valve 325 are opened similarly to the second embodiment. This thereby makes it possible to prevent the temperatures of the exhaust hoods of the superhigh-pressure turbine 230 and the first intermediate-pressure turbine 240 from being increased by windage loss.

According to the steam turbine plant 11 of the third embodiment, in addition to the operation and the effect of the steam turbine plant 11 of the second embodiment, it is possible to separately control the first intercept valve 294, the second intercept valve 322, the first ventilator valve 299, and the second ventilator valve 325 each. This makes it possible to accurately alleviate effects on the behavior of the steam turbine such as change in the turbine rotation speed and change in the load during driving of the steam turbine plant.

For example, it becomes possible to perform controls such that after the first intercept valve 294 is opened, the second intercept valve 322 is immediately opened and opening of the second intercept valve 322 is waited until the behavior of the steam turbine is stabilized.

In this manner, the first intercept valve 294, the second intercept valve 322, the first ventilator valve 299, and the second ventilator valve 325 are each controlled separately, thereby making it possible to improve controllability.

According to the above-explained embodiments, it becomes possible to stably control the start up of the steam turbine provided with the turbine bypass system.

While certain embodiments of the present invention have been described, these embodiments have been presented by way of example only, and are not intended to limit the scope of the inventions. Indeed, the novel methods described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and sprit of the inventions.

What is claimed is:

1. A steam turbine plant, comprising:

a power generator;

a superheater;

a high-pressure turbine connected to the superheater via a main steam pipe;

a reheater connected to the high-pressure turbine via a low-temperature reheat steam pipe provided with a check valve;

an intermediate-pressure turbine connected to the reheater via a high-temperature reheat steam pipe;

a low-pressure turbine into which steam exhausted from the intermediate-pressure turbine is introduced;

a condenser into which steam exhausted from the low-pressure turbine is introduced;

a high-pressure turbine bypass pipe that branches off the main steam pipe, is connected to the low-temperature reheat steam pipe downstream of the check valve bypassing the high-pressure turbine, and is provided with a high-pressure turbine bypass valve;

a low-pressure turbine bypass pipe that branches oil the high-temperature reheat steam pipe, is connected to the condenser bypassing the intermediate-pressure turbine and the low-pressure turbine, and is provided with a low-pressure turbine bypass valve; and a branch pipe that branches off the low-temperature reheat steam pipe positioned upstream from the check valve, is connected to the condenser, and is provided with a ventilator valve, the main steam pipe being provided with a main steam stop valve and a steam control valve downstream from a branch portion that branches off the main steam pipe, and an electronic control device programmed to:

fully open the ventilator valve, the high-pressure turbine bypass valve, and the low-pressure turbine bypass valve at the time of turbine start up to allow steam to be circulated into the high-pressure turbine and the intermediate-pressure turbine simultaneously, to increase a turbine rotation speed to a previously set rated rotation speed, combine the power generator to an electric system at the time of the rotation speed reaching the previously set rated rotation speed to increase a load of the power generator, switch full arc admission by the main steam stop valve to partial arc admission by the steam control valve at the time of the load becoming an initial load, and gradually close the ventilator valve according to an opening operation of the steam control valve from a first opening state to a second opening state to prevent falling of the load, in the first opening state the steam control valve is partially opened, in the second opening state the steam control valve is opened wider than in the first opening state.

2. The steam turbine plant according to claim 1, wherein the electronic control device is further programmed to gradually close the high-pressure turbine bypass valve and the low-pressure turbine bypass valve according to a second opening operation of the steam control valve from the second opening state.

3. The steam turbine plant according to claim 2, wherein the electronic control device is further programmed to fully open the high-pressure turbine bypass valve and the ventilator valve when the steam control valve is fully closed.

4. The steam turbine plant according to claim 2, the high-temperature reheat steam pipe being provided with an intercept valve downstream from a second branch portion, and wherein the electronic control device is further programmed to keep a turbine rotation speed constant by regulating the steam control valve and the intercept valve when the ventilator valve, the high-pressure turbine bypass valve, and the low-pressure turbine bypass valve are close-operated with the opening operation of the steam control valve.

5. The steam turbine plant according to claim 4, wherein the electronic control device is further programmed to fully open the intercept valve and fully close the low-pressure turbine bypass valve while the turbine rotation speed is kept constant by regulating the steam control valve and the intercept valve.

6. A steam turbine plant, comprising:

a power generator;

a superheater;

a superhigh-pressure turbine connected to the superheater via a main steam pipe;

a first reheater connected to the superhigh-pressure turbine via a first low-temperature reheat steam pipe provided with a superhigh-pressure check valve;

a first intermediate-pressure turbine connected to the first reheater via a first high-temperature reheat steam pipe;

a second reheater connected to the first intermediate-pressure turbine via a second low-temperature reheat steam pipe provided with a check valve;

a second intermediate-pressure turbine connected to the second reheater via a second high-temperature reheat steam pipe;

a low-pressure turbine into which steam exhausted from the second intermediate-pressure turbine is introduced;

a condenser into which steam exhausted from the low-pressure turbine is introduced;

a superhigh-pressure turbine bypass pipe that branches off the main steam pipe, is connected to the first low-temperature reheat steam pipe downstream of the superhigh-pressure check valve bypassing the superhigh-pressure turbine, and is provided with a superhigh-pressure turbine bypass valve;

an intermediate-pressure turbine bypass pipe that branches off the first high-temperature reheat steam pipe, is connected to the second low-temperature reheat steam pipe downstream of the check valve bypassing the first intermediate-pressure turbine, and is provided with an intermediate-pressure turbine bypass valve;

a low-pressure turbine bypass pipe that branches off the second high-temperature reheat steam pipe, is connected to the condenser bypassing the second intermediate-pressure turbine and the low-pressure turbine, and is provided with a low-pressure turbine bypass valve;

a first branch pipe that branches off the first low-temperature reheat steam pipe positioned upstream from the superhigh-pressure check valve, is connected to the condenser, and is provided with a first ventilator valve, and a second branch pipe that branches off the second low-temperature reheat steam pipe positioned upstream from the check valve, is connected to the condenser, and is provided with a second ventilator valve, the main steam pipe being provided with a superhigh-pressure main steam stop valve and a superhigh-pressure steam control valve downstream from a first branch portion that branches off the main steam pipe, the first high-temperature reheat steam pipe being provided with a first intercept valve downstream from a second branch portion that branches off the first high-temperature reheat steam pipe, and an electronic control device programmed to:

fully open the first ventilator valve, the second ventilator valve, the superhigh-pressure turbine bypass valve, the intermediate-pressure turbine bypass valve, and the low-pressure turbine bypass valve at the time of turbine start up to allow steam to be circulated into the superhigh-pressure turbine, the first intermediate-pressure turbine, and the second intermediate-pressure turbine simultaneously, to increase a turbine rotation speed to a previously set rated rotation speed, combine the power generator to an electric system at the time of the rotation speed reaching the previously set rated rotation speed to increase a load of the power generator, switch full arc admission by the superhigh-pressure main steam stop valve to partial arc admission by the superhigh-pressure steam control valve at the time of the load becoming an initial load, and gradually close the first ventilator valve and the second ventilator valve simultaneously according to an opening operation of the superhigh-pressure steam control valve from a first opening state to a second opening state to prevent falling of the load, in the first opening state the superhigh-pressure steam control valve is partially opened, in the second opening state the superhigh-pressure steam control valve is opened wider than in the first opening state.

7. The steam turbine plant according to claim 6, wherein the electronic control device is further programmed to gradually close the superhigh-pressure turbine bypass valve, the intermediate-pressure turbine bypass valve, and the low-pressure turbine bypass valve according to an opening operation of the superhigh-pressure steam control valve and the first intercept valve.

8. The steam turbine plant according to claim 7, wherein the electronic control device is further programmed to fully open the superhigh-pressure turbine bypass valve and the first ventilator valve in a condition when the superhigh-pressure steam control valve is brought into a fully dosed state.

9. The steam turbine plant according to claim 7, wherein the electronic control device is further programmed to fully open the intermediate-pressure turbine bypass valve and the second ventilator valve in a condition when a first intercept valve is brought into a fully dosed state.

10. The steam turbine plant according to claim 7, the second high-temperature reheat steam pipe being provided with, downstream from a third branch portion that branches off the second high-temperature reheat steam pipe, a second intercept valve that performs the same operation simultaneously with the first intercept valve, and wherein the electronic control device is further programmed to keep a turbine rotation speed constant by regulating the superhigh-pressure steam control valve, the first intercept valve, and the second intercept valve when the first ventilator valve, the second ventilator valve, the superhigh-pressure turbine bypass valve, the intermediate-pressure turbine bypass valve, and the low-pressure turbine bypass valve are close-operated with the opening operation of the superhigh-pressure steam control valve and the first intercept valve.

11. The steam turbine plant according to claim 10, wherein the electronic control device is further programmed to fully open the first intercept valve and the second intercept valve and fully close the intermediate-pressure turbine bypass valve and the low-pressure turbine bypass valve while the turbine rotation speed is kept constant by regulating the superhigh-pressure steam control valve, the first intercept valve, and the second intercept valve.

12. The steam turbine plant according to claim 6, wherein the electronic control device is further programmed to close the first ventilator valve, the second ventilator valve, the superhigh-pressure turbine bypass valve, the intermediate-pressure turbine bypass valve, and the low-pressure turbine bypass valve with an opening operation of the superhigh-pressure steam control valve and the first intercept valve and the first ventilator valve and the second ventilator valve perform the same operation with a time lag between the closing time of the first ventilator valve and the closing time of the second ventilator valve.

13. The steam turbine pant according to claim 12, wherein the electronic control device is further programmed to fully open the superhigh-pressure turbine bypass valve and the first ventilator valve in a condition when the superhigh-pressure steam control valve is fully closed.

14. The steam turbine plant according to claim 12, wherein the electronic control device is further programmed to fully open the intermediate-pressure turbine bypass valve and the second ventilator valve in a condition when a first intercept valve is fully closed.

15. The steam turbine plant according to claim 12, the second high-temperature reheat steam pipe being provided with, downstream from a third branch portion that branches off the second high-temperature reheat steam pipe, a second intercept valve that performs the same operation as the first intercept valve with a time lag between the closing time of the first intercept valve and the closing time of the second intercept valve, and wherein the electronic control device is further programmed to keep a turbine rotation speed constant by regulating the superhigh-pressure steam control valve, the first intercept valve, and the second intercept valve when the first ventilator valve, the second ventilator valve, the superhigh-pressure turbine bypass valve, the intermediate-pressure turbine bypass valve, and the low-pressure turbine bypass valve are close-operated with the opening operation of the superhigh-pressure steam control valve and the first intercept valve.

16. The steam turbine plant according to claim 15, wherein the electronic control device is further programmed to fully open the first intercept valve, and the second intercept valve and fully close the intermediate-pressure turbine bypass valve and the low-pressure turbine bypass valve while the turbine rotation speed is kept constant by regulating the superhigh-pressure steam control valve, the first intercept valve, and the second intercept valve.

17. A driving method of a steam turbine plant including:

a power generator;

a superheater;

a high-pressure turbine connected to the superheater via a main steam pipe provided with a main steam stop valve and a steam control valve;

a reheater connected to the high-pressure turbine via a low-temperature reheat steam pipe provided with a check valve;

an intermediate-pressure turbine connected to the reheater via a high-temperature reheat steam pipe;

a low-pressure turbine into which steam exhausted from the intermediate-pressure turbine is introduced;

a condenser into which steam exhausted from the low-pressure turbine is introduced;

a high-pressure turbine bypass pipe that branches off the main steam pipe upstream from the main steam stop valve and the steam control valve, is connected to the low-temperature reheat steam pipe downstream of the check valve bypassing the high-pressure turbine, and is provided with a high-pressure turbine bypass valve;

a low-pressure turbine bypass pipe that branches off the high-temperature reheat steam pipe, is connected to the condenser bypassing the intermediate-pressure turbine and the low-pressure turbine, and is provided with a low-pressure turbine bypass valve; and a branch pipe that branches off the low-temperature reheat steam pipe positioned upstream from the check valve, is connected to the condenser, and is provided with a ventilator valve, the main steam pipe being provided with a main steam stop valve and a steam control valve downstream from a branch portion that branches off the main steam pipe, the driving method comprising:

at the time of turbine start up, fully opening the ventilator valve, the high-pressure turbine bypass valve, and the low-pressure turbine bypass valve and circulating steam into the high-pressure turbine and the intermediate pressure turbine simultaneously, to increase a turbine rotation speed to a previously set rated rotation speed;

at the time of the rotation speed reaching the previously set rated rotation speed, combining the power generator to an electric system to increase a load of the power generator;

at the time of the load becoming an initial load, switching full arc admission by the main steam stop valve to partial arc admission by the steam control valve; and gradually closing the ventilator valve according to an opening operation of the steam control valve from a first opening state to a second opening state to prevent falling of the load, in the first opening state the steam control valve is partially opened, in the second opening state the steam control valve is opened wider than in the first opening state.

18. A driving method of a steam turbine plant including:

a power generator;

a superheater;

a superhigh-pressure turbine connected to the superheater via a main steam pipe provided with a superhigh-pressure main steam stop valve and a superhigh-pressure steam control valve, a first reheater connected to the superhigh-pressure turbine via a first low-temperature reheat steam pipe provided with a superhigh-pressure check valve;

a first intermediate-pressure turbine connected to the first reheater via a first high-temperature reheat steam pipe provided with a first intercept valve;

a second reheater connected to the first intermediate-pressure turbine via a second low-temperature reheat steam pipe provided with a check valve;

a second intermediate-pressure turbine connected to the second reheater via a second high-temperature reheat steam pipe;

a low-pressure turbine into which steam exhausted from the second intermediate-pressure turbine is introduced;

a condenser into which steam exhausted from the low-pressure turbine is introduced;

a superhigh-pressure turbine bypass pipe that branches off the main steam pipe upstream from the superhigh-pressure main steam stop valve and the superhigh-pressure steam control valve, is connected to the first low-temperature reheat steam pipe downstream of the superhigh-pressure check valve bypassing the superhigh-pressure turbine, and is provided with a superhigh-pressure turbine bypass valve;

an intermediate-pressure turbine bypass pipe that branches off the first high-temperature reheat steam pipe upstream from the first intercept valve, is connected to the second low-temperature reheat steam pipe downstream of the check valve bypassing the first intermediate-pressure turbine, and is provided with an intermediate-pressure turbine bypass valve;

a low-pressure turbine bypass pipe that branches off the second high-temperature reheat steam pipe, is connected to the condenser bypassing the second intermediate-pressure turbine and the low-pressure turbine, and is provided with a low-pressure turbine bypass valve;

a first branch pipe that branches off the first low-temperature reheat steam pipe positioned upstream from the superhigh-pressure check valve, is connected to the condenser, and is provided with a first ventilator valve; and a second branch pipe that branches off the second low-temperature reheat steam pipe positioned upstream from the check valve, is connected to the condenser, and is provided with a second ventilator valve, the main steam pipe being provided with a superhigh-pressure main steam stop valve and a superhigh-pressure steam control valve downstream from a first branch portion that branches off the main steam pipe, the first high-temperature reheat steam pipe being provided with a first intercept valve downstream from a second branch portion that branches off the first high-temperature reheat steam pipe, the driving method comprising:

at the time of turbine start up, fully opening the first ventilator valve, the second ventilator valve, the superhigh-pressure turbine bypass valve, the intermediate-pressure turbine bypass valve, and the low-pressure turbine bypass valve and circulating steam into the superhigh-pressure turbine, the first intermediate-pressure turbine, and the second intermediate-pressure turbine simultaneously, to increase a turbine rotation speed to a previously set rated rotation speed; and at the time of the rotation speed reaching the previously set rated rotation speed, combining the power generator to an electric system to increase a load of the power generator;

at the time of the load becoming an initial load, switching full arc admission by the superhigh-pressure main steam stop valve to partial arc admission by the superhigh-pressure steam control valve; and gradually closing the first ventilator valve and the second ventilator valve simultaneously according to an opening operation of the superhigh-pressure steam control valve from a first opening state to a second opening state to prevent falling of the load, in the first opening state the superhigh-pressure steam control valve is partially opened, in the second opening state the superhigh-pressure steam control valve is opened wider than in the first opening state.

19. The driving method of the steam turbine plant according to claim 18, wherein the first ventilator valve and the second ventilator valve perform the same operation simultaneously.

20. The driving method of the steam turbine plant according to claim 18, wherein the first ventilator valve and the second ventilator valve perform the same operation with a time lag between the closing time of the first ventilator valve and the closing time of the second ventilator valve.

* * * * *